US010646890B2

(12) United States Patent
Mareli et al.

(10) Patent No.: US 10,646,890 B2
(45) Date of Patent: May 12, 2020

(54) SPRINKLER RISER ASSEMBLY

(71) Applicant: NAANDANJAIN IRRIGATION LTD., Kibbutz Naan (IL)

(72) Inventors: Lior Eliahu Mareli, Rehovot (IL); Gideon Erez, Kibbutz Naan (IL)

(73) Assignee: NAANDANJAIN IRRIGATION LTD., Kibbutz Naan (IL)

( * ) Notice: Subject to any disclaimer, the term of this patent is extended or adjusted under 35 U.S.C. 154(b) by 0 days.

(21) Appl. No.: 15/458,400

(22) Filed: Mar. 14, 2017

(65) Prior Publication Data

US 2018/0264500 A1 Sep. 20, 2018

(51) Int. Cl.
*B05B 15/62* (2018.01)
*B05B 15/625* (2018.01)
*B05B 15/65* (2018.01)

(52) U.S. Cl.
CPC ..... *B05B 15/62* (2018.02); *B05B 15/625* (2018.02); *B05B 15/65* (2018.02)

(58) Field of Classification Search
CPC ..... B05B 15/061–065; B05B 15/069; B05B 15/62–628; B05B 15/65; B05B 15/658; F16L 37/1205
USPC ..... 239/203–206, 273–285, 600; 285/305, 285/320
See application file for complete search history.

(56) References Cited

U.S. PATENT DOCUMENTS 2,585,782 A 2/1952 Johnson
2,704,679 A * 3/1955 Stilwell ..... F16L 37/54 285/27
2,901,183 A 8/1959 Kohl
3,131,867 A 5/1964 Miller et al.
3,282,508 A 11/1966 Roberts
3,709,435 A 1/1973 Sheets
3,727,842 A 4/1973 Ertsgaard et al.
3,843,059 A * 10/1974 Segev ..... B05B 15/625 239/273
3,921,911 A 11/1975 Sheets
3,955,764 A 5/1976 Phaup
4,113,181 A 9/1978 Sheets
4,145,003 A 3/1979 Harrison et al.
4,429,832 A 2/1984 Sheets
(Continued)

FOREIGN PATENT DOCUMENTS

WO 2005/011359 2/2005

OTHER PUBLICATIONS

Marlow, Frank M.; Machine Shop Essentials; "Fastening Methods", Chapter 9; Metal Arts Press, Second Edition, May 2011 (Year: 2011).*

(Continued)

*Primary Examiner* — Cody J Lieuwen
(74) *Attorney, Agent, or Firm* — Sughrue Mion, PLLC

(57) ABSTRACT

A sprinkler riser assembly including a stabilizer base and a riser mount and coupler, removably mountable onto the stabilizer base, the stabilizer base including at least one pressure mount portion and at least one stabilizer base snap engagement portion and the riser mount and coupler including a slidable portion for slidable engagement with the at least one pressure mount portion of the stabilizer base and at least one riser mount and coupler snap engagement portion for operative removable snap fit engagement with the at least one stabilizer base snap engagement portion.

11 Claims, 23 Drawing Sheets

(56) References Cited

U.S. PATENT DOCUMENTS

| | | | | |
|---|---|---|---|---|
| 4,637,548 | A | 1/1987 | Ray et al. | |
| 4,717,077 | A * | 1/1988 | Takata | B05B 15/658 239/548 |
| 4,754,925 | A | 7/1988 | Rubinstein | |
| 4,763,838 | A | 8/1988 | Holcomb | |
| 4,796,804 | A | 1/1989 | Weiss | |
| 4,796,810 | A | 1/1989 | Zakai | |
| 4,834,290 | A | 5/1989 | Bailey | |
| 4,919,332 | A | 4/1990 | Bailey | |
| 6,000,634 | A | 12/1999 | Mehoudar | |
| 6,016,972 | A | 1/2000 | Kantor et al. | |
| 6,186,413 | B1 | 2/2001 | Lawson | |
| 6,340,059 | B1 * | 1/2002 | Bethea | A62C 31/02 169/16 |
| 6,439,476 | B1 | 8/2002 | Boggs | |
| 6,457,656 | B1 | 10/2002 | Scott | |
| 8,079,531 | B2 | 12/2011 | Katzman et al. | |
| 8,083,158 | B2 | 12/2011 | Katzman et al. | |
| 2002/0153432 | A1 | 10/2002 | McKenzie et al. | |
| 2005/0236166 | A1 * | 10/2005 | Bentzien | B05B 15/65 169/37 |
| 2007/0095935 | A1 | 5/2007 | Katzman et al. | |
| 2008/0164341 | A1 | 7/2008 | Katzman et al. | |
| 2010/0127101 | A1 * | 5/2010 | Stadtler | E03C 1/084 239/428.5 |
| 2016/0263609 | A1 * | 9/2016 | Holmes | F16L 15/006 |

OTHER PUBLICATIONS

An International Search Report and a Written Opinion both dated Nov. 15, 2004, which issued during the prosecution of Applicant's PCT/IL2004/00673.

An International Preliminary Report on Patentability dated May 31, 2005, which issued during the prosecution of Applicant's PCT/IL2004/00673.

An Office Action dated Aug. 18, 2008, which issued during the prosecution of U.S. Appl. No. 10/567,252.

An Office Action dated Jan. 30, 2009, which issued during the prosecution of U.S. Appl. No. 10/567,252.

An Office Action dated Jun. 4, 2010, which issued during the prosecution of U.S. Appl. No. 10/567,252.

An Office Action dated Mar. 3, 2011, which issued during the prosecution of U.S. Appl. No. 10/567,252.

An Office Action dated Nov. 3, 2009, which issued during the prosecution of U.S. Appl. No. 10/567,252.

An Office Action dated Jun. 24, 2010, which issued during the prosecution of U.S. Appl. No. 11/589,869.

An Office Action dated Aug. 3, 2009, which issued during the prosecution of U.S. Appl. No. 11/589,869.

An Office Action dated Nov. 30, 2009, which issued during the prosecution of U.S. Appl. No. 11/589,869.

Notice of Allowance dated Aug. 18, 2011, which issued during the prosecution U.S. Appl. No. 10/567,252.

Notice of Allowance dated Aug. 25, 2011, which issued during the prosecution U.S. Appl. No. 11/589,869.

* cited by examiner

SPRINKLER RISER ASSEMBLY

FIELD OF THE INVENTION

The present invention relates generally to sprinkler irrigation systems and more particularly to sprinkler riser assemblies therefor.

BACKGROUND OF THE INVENTION

Various types of sprinkler riser assemblies are known in the art.

SUMMARY OF THE INVENTION

The present invention seeks to provide an improved, easily assembled and highly robust sprinkler riser assembly.

There is thus provided in accordance with a preferred embodiment of the present invention a sprinkler riser assembly including a stabilizer base and a riser mount and coupler, removably mountable onto the stabilizer base, the stabilizer base including at least one pressure mount portion and at least one stabilizer base snap engagement portion and the riser mount and coupler including a slidable portion for slidable engagement with the at least one pressure mount portion of the stabilizer base and at least one riser mount and coupler snap engagement portion for operative removable snap fit engagement with the at least one stabilizer base snap engagement portion.

Preferably, the at least one stabilizer base snap engagement portion and the riser mount and coupler snap engagement portion are configured such that application of a tensile force urging sliding disengagement of the riser mount and coupler snap engagement portion from the at least one stabilizer base snap engagement portion is operative to increase resistance to disengagement of the slidable portion of the riser mount and coupler from the stabilizer base.

In accordance with a preferred embodiment of the present invention the at least one riser mount and coupler snap engagement portion includes a protrusion extending from the slidable portion and the at least one stabilizer base snap engagement portion includes a moveable element for operative removable snap fit engagement with the protrusion, the application of the tensile force creating a torque on the moveable element causing rotation of the moveable element about an axis of rotation thereof, the rotation urging the protrusion in a direction towards the at least one pressure mount portion, thereby increasing resistance to disengagement of the slidable portion from the at least one pressure mount portion. Additionally, the moveable element includes a resilient slanted portion terminating in a step-like segment, the step-like segment defining a recess for receiving the protrusion for snap fit engagement therewith.

In accordance with a preferred embodiment of the present invention the stabilizer base includes a surface and the at least one pressure mount portion includes at least one ridge formed on the surface, a gap being defined between the at least one ridge and the surface, the slidable portion being sized so as to be slidable within the gap. Additionally, the at least one pressure mount portion includes an even number of pressure mount portions symmetrically arranged with respect to the at least one stabilizer base snap engagement portion.

Preferably, the sprinkler riser assembly also includes at least one manually operable removably engageable hook removably attachable to the riser mount and coupler. Additionally, the riser mount and coupler includes at least one lateral rib, the at least one manually operable removably engageable hook being removably attachable to the at least one lateral rib. Additionally, the manually operable removably engageable hook includes at least one manually operable removably engageable hook pin-receiving hole and the at least one lateral rib includes at least one rib pin-receiving hole, the manually operable removably engageable hook being attachable to the at least one lateral rib by insertion of a pin through the manually operable removably engageable hook and rib pin-receiving holes.

In accordance with a preferred embodiment of the present invention the manually operable removably engageable hook pin-receiving hole includes a bore, the bore having an irregular inner surface. Additionally, the irregular inner surface includes a multiplicity of notches.

In accordance with a preferred embodiment of the present invention the at least one rib pin-receiving hole is partially but not fully circumferentially surrounded by a shoulder. Additionally, the shoulder circumferentially surrounds at least a quarter of a circumference of the at least one rib pin-receiving hole.

Preferably, the pin includes a head portion and a shank portion, a gap being defined between the head portion and the at least one lateral rib upon the insertion of the pin through the manually operable removably engageable hook and rib pin-receiving holes.

In accordance with a preferred embodiment of the present invention the at least one lateral rib includes a first lateral rib and a second lateral rib and the at least one lateral rib pin-receiving hole includes a first rib pin-receiving hole formed in the first lateral rib and a second rib pin-receiving hole formed in the second lateral rib, the first and second lateral rib pin-receiving holes being generally mutually aligned. Additionally, the shank portion has a gradated diameter successively engageable with the first and second rib pin-receiving holes.

There is also provided in accordance with another preferred embodiment of the present invention a riser mount and coupler for incorporation in a sprinkler riser assembly, the riser mount and coupler including a slidable portion adapted for slidable engagement with at least one pressure mount portion of a stabilizer base and at least one riser mount and coupler snap engagement portion adapted for operative removable snap fit engagement with at least one stabilizer base snap engagement portion of the stabilizer base, the riser mount and coupler being removably mountable onto the stabilizer base.

In accordance with a preferred embodiment of the present invention the at least one stabilizer base snap engagement portion and the riser mount and coupler snap engagement portion are configured such that application of a tensile force urging sliding disengagement of the riser mount and coupler snap engagement portion from the at least one stabilizer base snap engagement portion is operative to increase resistance to disengagement of the slidable portion of the riser mount and coupler from the stabilizer base.

There is further provided in accordance with yet another preferred embodiment of the present invention a stabilizer base for incorporation in a sprinkler riser assembly, the stabilizer base including at least one pressure mount portion adapted to engage a slidable portion of a riser mount and coupler and at least one stabilizer base snap engagement portion adapted for operative removable snap fit engagement with at least one riser mount and coupler snap engagement portion of the riser mount and coupler, the stabilizer base being adapted for removable mounting of the riser mount and coupler thereunto.

Preferably, the at least one stabilizer base snap engagement portion and the riser mount and coupler snap engagement portion are configured such that application of a tensile force urging sliding disengagement of the riser mount and coupler snap engagement portion from the at least one stabilizer base snap engagement portion is operative to increase resistance to disengagement of the slidable portion of the riser mount and coupler from the stabilizer base.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
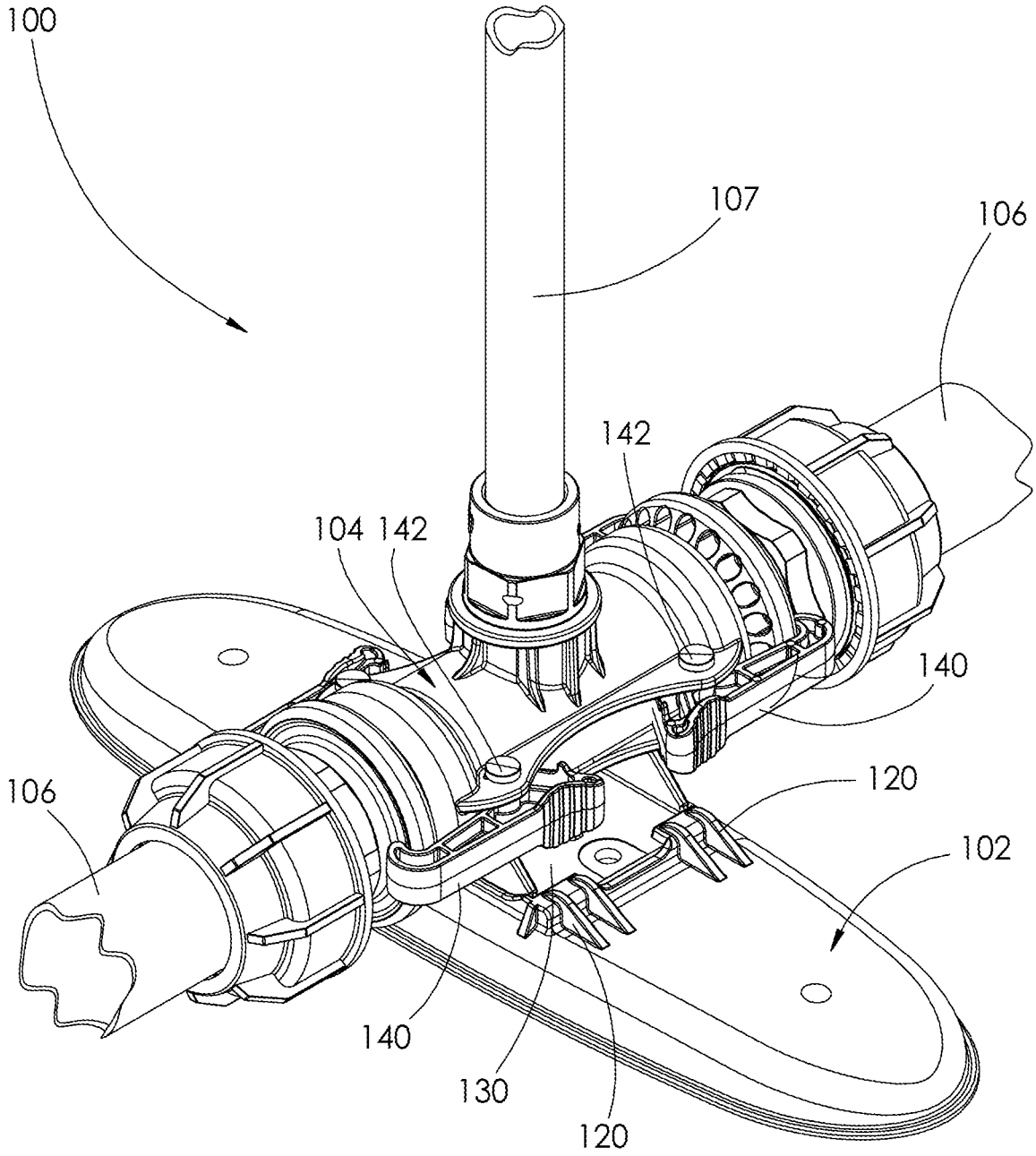
FIGS. 1A, 1B and 1C are simplified schematic respective assembled, exploded and enlarged exploded view illustrations of a sprinkler riser assembly including a stabilizer base and a riser mount and coupler, constructed and operative in accordance with a preferred embodiment of the present invention.
Figure 1B:
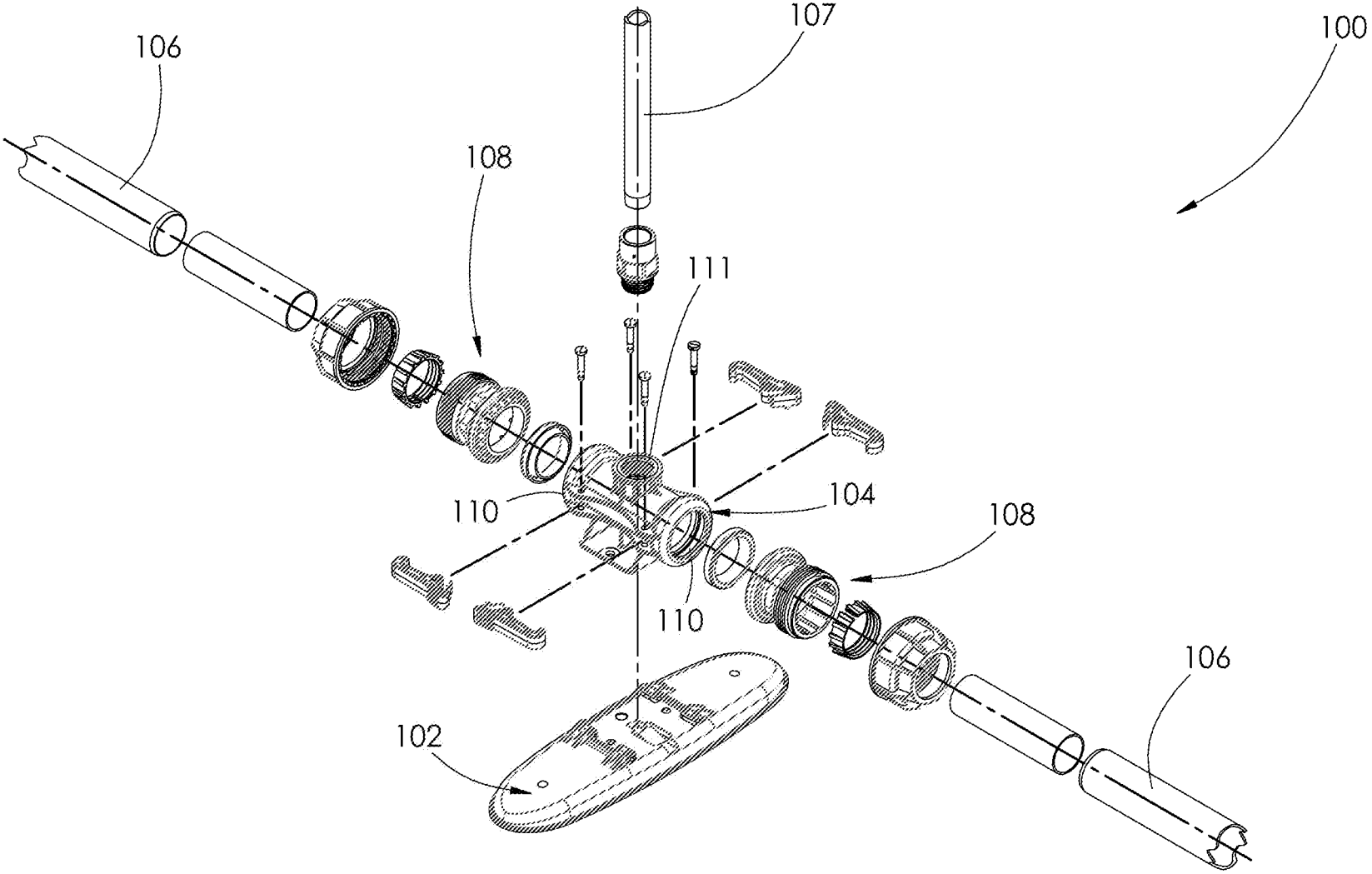
Figure 1C:
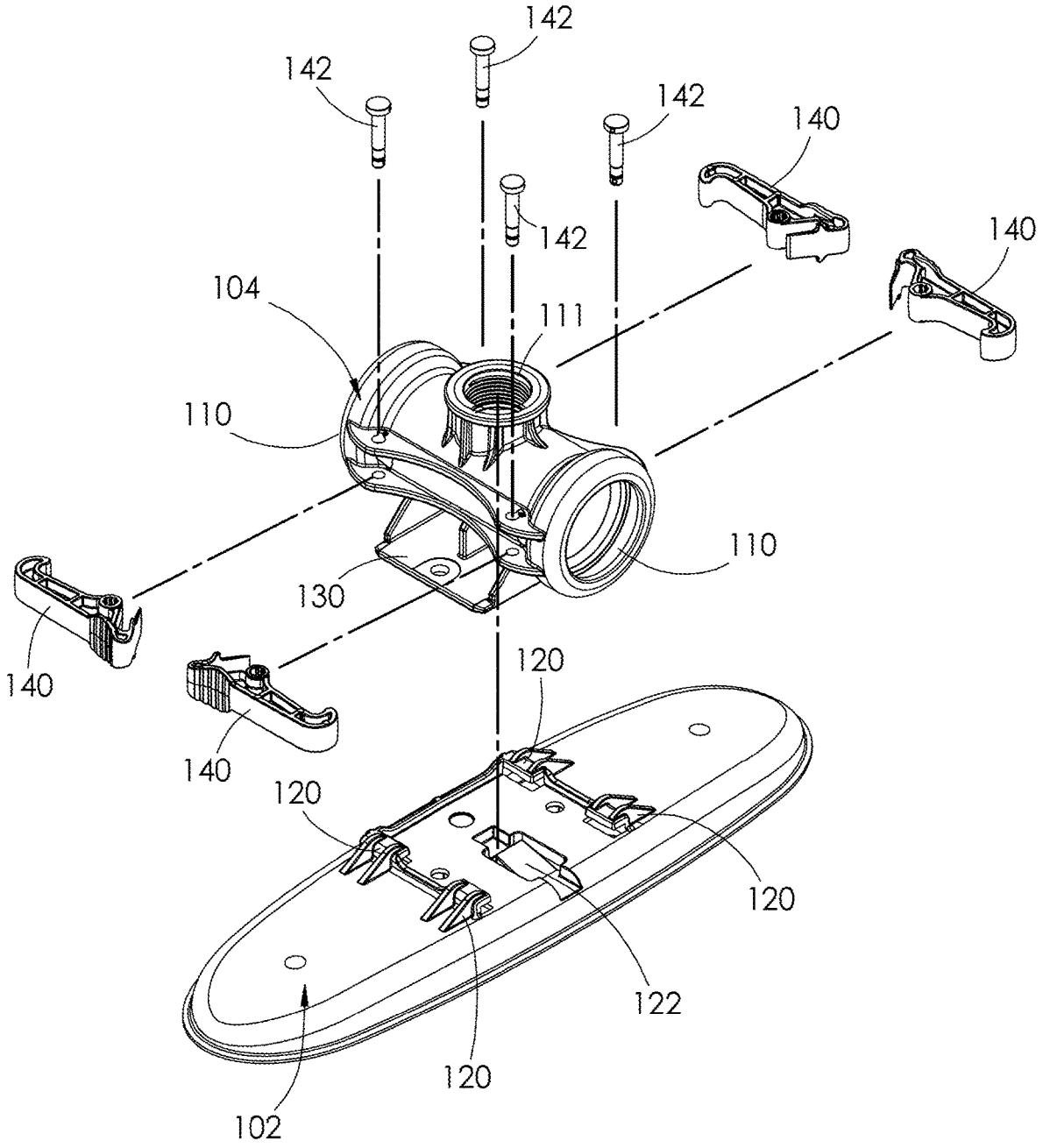

Reference is now made to FIGS. 1A, 1B and 1C, which are simplified schematic respective assembled, exploded and enlarged exploded view illustrations of a sprinkler riser assembly including a stabilizer base and a riser mount and coupler, constructed and operative in accordance with a preferred embodiment of the present invention.

As seen in FIGS. 1A-1C, there is provided a sprinkler riser assembly 100, preferably including a stabilizer base 102 and a riser mount and coupler 104 removably mountable thereon. Sprinkler riser assembly 100 is preferably adapted for use in sprinkler irrigation systems, for supporting and/or connecting sets of pipes thereto, such as pipes 106 and riser 107 shown in FIGS. 1A and 1B.

Pipes 106 may be connected to riser mount and coupler 104 by way of one or more connecting elements, here illustrated, by way of example, as a plurality of various mateable connecting elements 108 for connecting pipes 106 to openings 110 and riser 107 to an opening 111 of riser mount and coupler 104. It is appreciated, however, that the particular number and configuration of pipes 106, connecting elements 108 and openings 110 illustrated herein are exemplary only and that riser mount and coupler 104 may be embodied as any suitable riser mount and coupler removably mountable on stabilizer base 102 in a manner detailed hereinbelow.

As seen most clearly in FIG. 1C, stabilizer base 102 preferably includes at least one pressure mount portion, here embodied, by way of example, as four pressure mount portions 120. Stabilizer base 102 further preferably includes at least one stabilizer base snap engagement portion 122, here embodied, by way of example, as a single snap engagement portion 122.

Figure 2A:
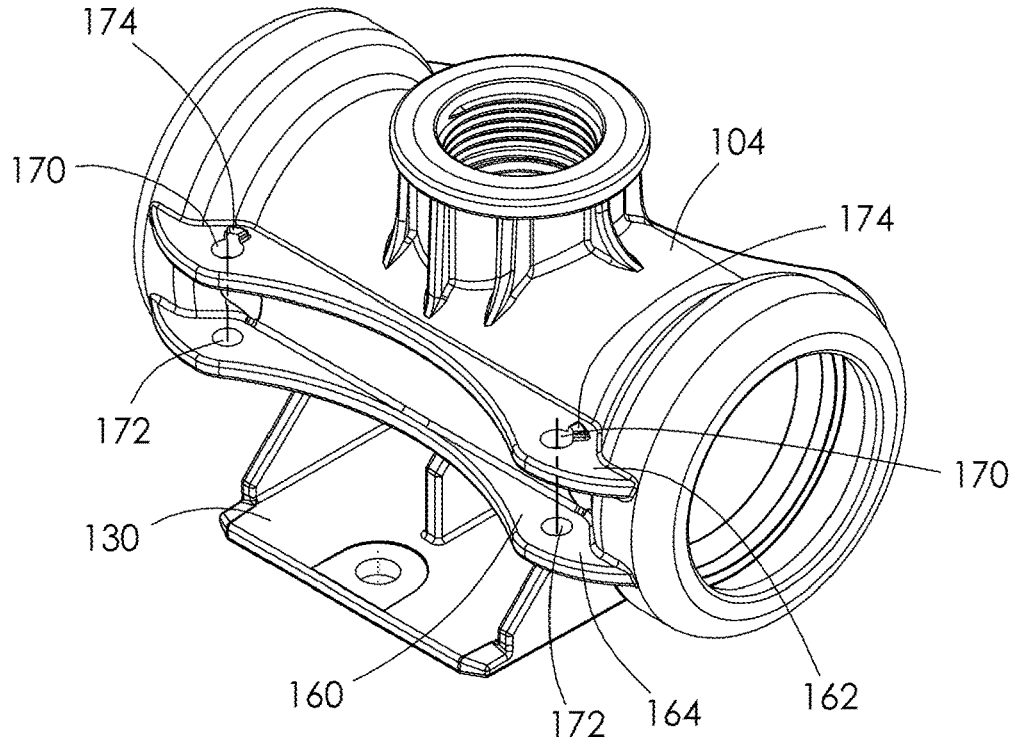
FIGS. 2A, 2B and 2C are simplified schematic respective top-side perspective, under-side perspective and top view illustrations of a riser mount and coupler of a type shown in FIGS. 1A-1C.
Figure 2B:
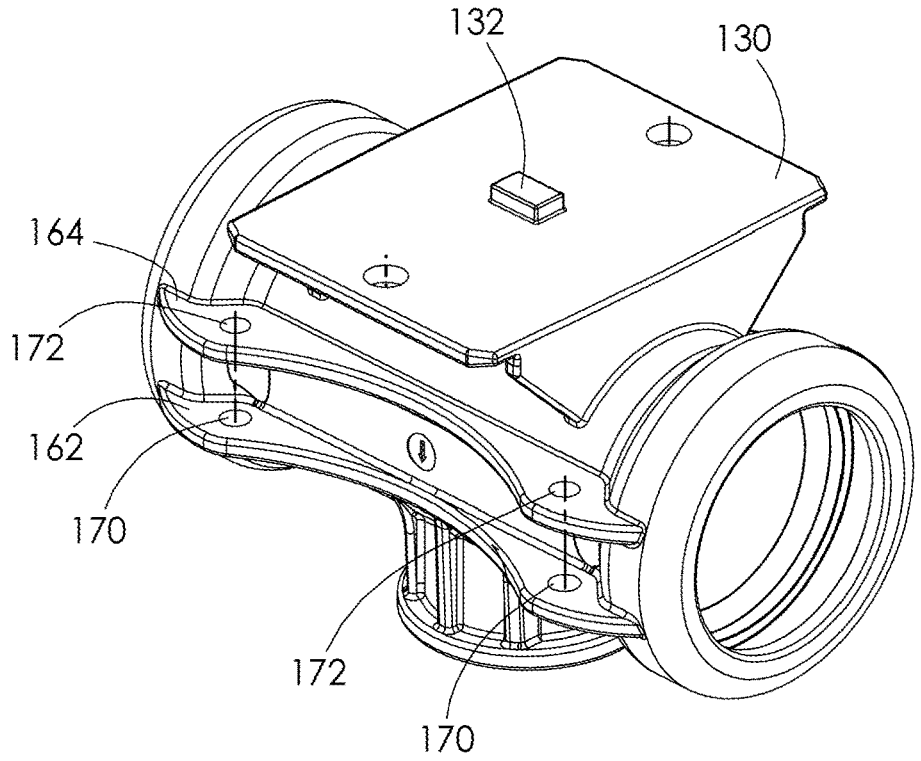
Figure 2C:
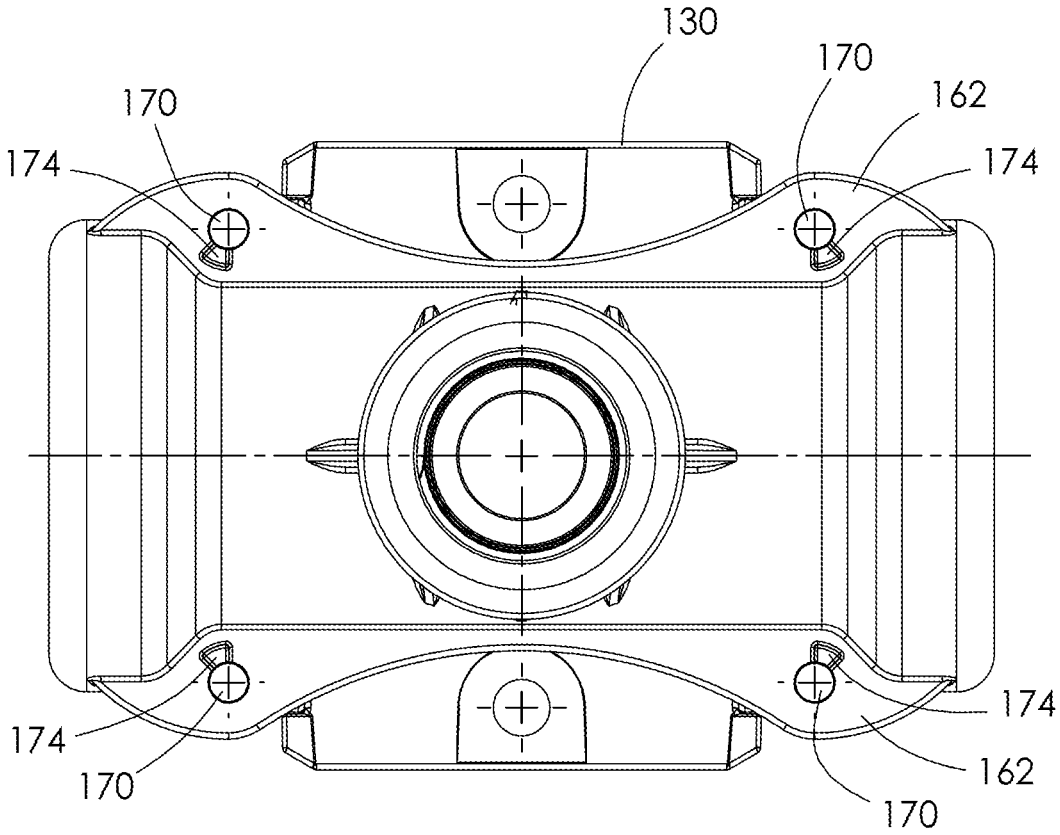

Referring additionally to FIGS. 2A, 2B and 2C, which are simplified schematic respective top-side perspective, under-side perspective and top view illustrations of riser mount and coupler 104, it is seen that riser mount and coupler 104 preferably includes a generally planar slidable portion 130 for slidable engagement with the at least one pressure mount portion 120 of stabilizer base 102. As seen most clearly in FIG. 2B, riser mount and coupler 104 further preferably includes at least one riser mount and coupler snap engagement portion 132 for operative removable snap fit engagement with the at least one stabilizer base snap engagement portion 122 of stabilizer base 102.

Riser mount and coupler 104 may be removably mounted onto stabilizer base 102 by slidingly engaging slidable portion 130 with the at least one pressure mount portion 120 and, preferably at least partially simultaneously, by snap fit engaging riser mount and coupler snap engagement portion 132 with stabilizer base snap engagement portion 122. Riser mount and coupler 104 in combination with stabilizer base 102 thereby forms a highly robust, easily assembled, riser assembly.

It is appreciated that the inclusion of four pressure mount portions 120 and a single snap fit engagement portion 122 in stabilizer base 102 is exemplary only, and that stabilizer base 102 may include a greater or fewer number of pressure mount portions 120 and/or a greater number of snap fit engagement portions 122, in accordance with the design requirements thereof. In accordance with preferred embodiments of the present invention, the at least one pressure mount portion is embodied as an even number of pressure mount portions, preferably generally symmetrically arranged with respect to the at least one stabilizer base snap engagement portion.

Figure 7A:
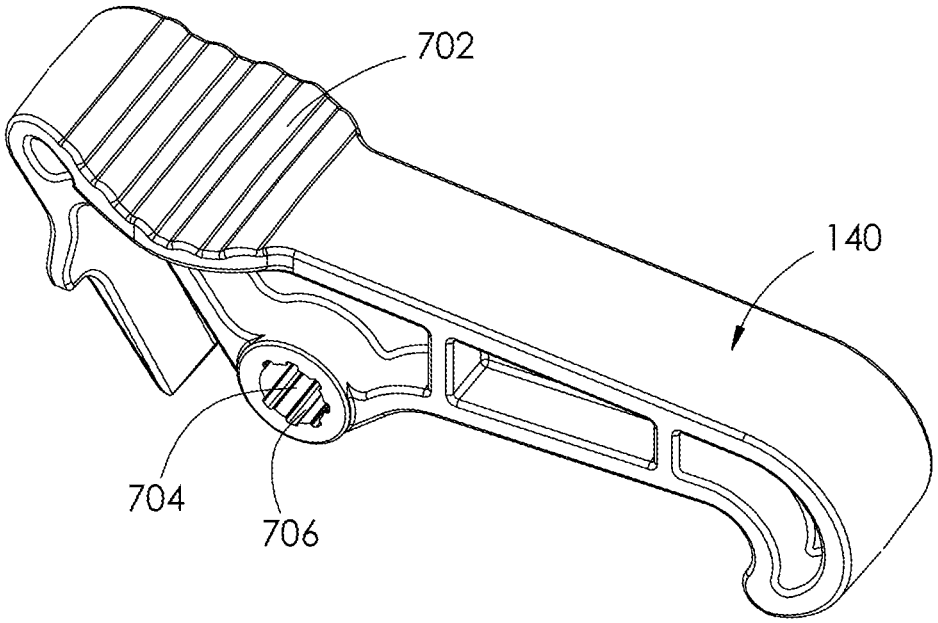
FIGS. 7A-7D are simplified schematic respective first and second perspective, side and top view illustrations of a manually operable removably engageable hook portion of a sprinkler riser assembly of a type shown in FIGS. 1A-1C, constructed and operative in accordance with a preferred embodiment of the present invention.
Figure 7B:
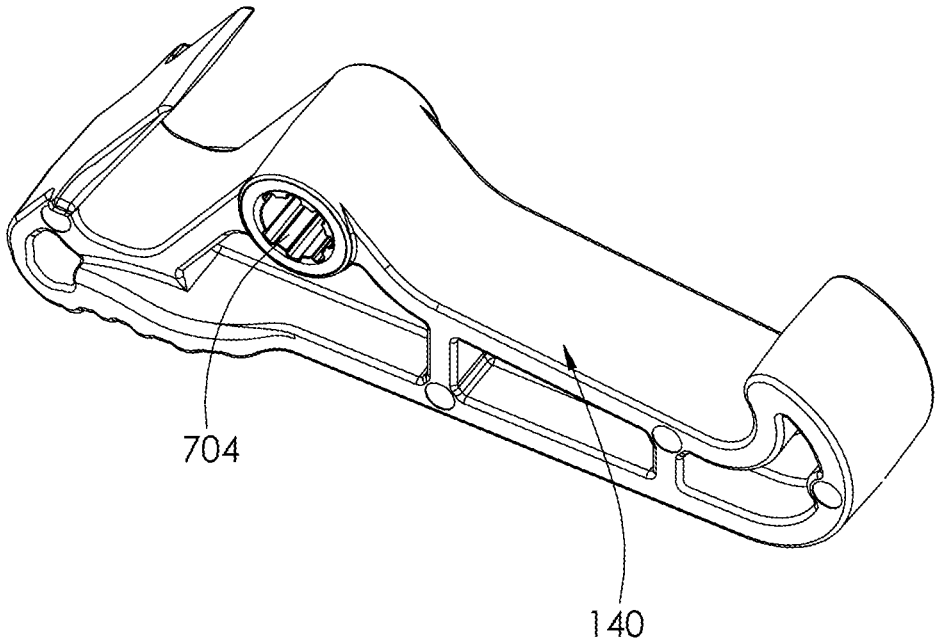
Figure 7C:
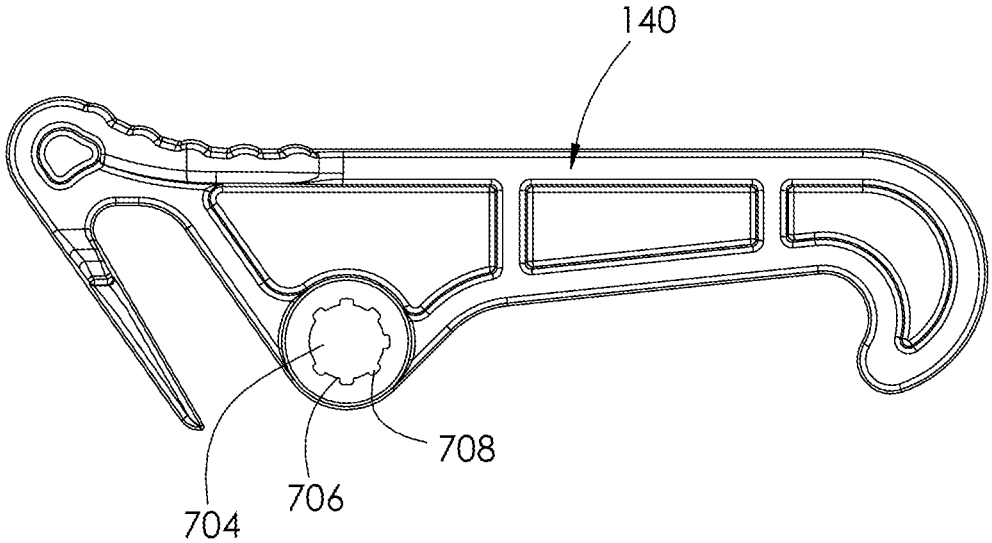
Figure 7D:
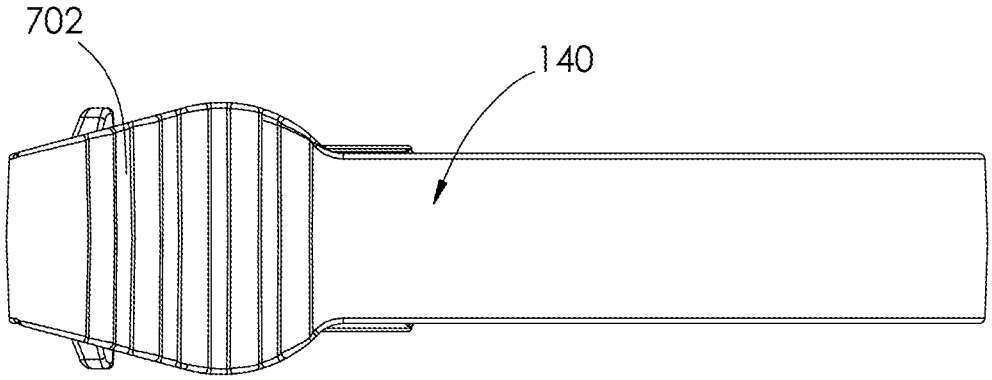

Riser mount and coupler 104 may additionally include at least one manually operable removably engageable hook, here embodied, by way of example, as first, second, third and fourth manually operable removably engageable hooks 140. Manually operable removably engageable hooks 140 are preferably operative to releasably grip connecting elements 108 and/or pipes 106 when inserted in riser mount and coupler 104. Each manually operable removably engageable hook 140 may be attached to riser mount and coupler 104 by way of a corresponding pin 142, insertable through a set of corresponding holes in riser mount and coupler 104 and manually operable removably engageable hook 140 respectively. Further details concerning the structure and cooperation of preferred embodiments of manually operable removably engageable hooks 140 and pins 142 are provided henceforth, with reference to FIGS. 7A 9C.

Turning again to FIGS. 2A-2C, slidable portion 130 is seen to be embodied, by way of example, as a generally flat slab, having a thickness so as to be slidably engageable with pressure mount portions 120. Riser mount and coupler snap engagement portion 132 is seen to be embodied, by way of example, as a protrusion emerging from an underside of slidable portion 130 and having dimensions enabling it to be removably snap fitted into stabilizer base snap engagement portion 122 and to be robustly retained therein notwithstanding substantial forces applied thereto, including, for example, forces resulting from the pressure of water in pipes 106, thermal expansion of pipes 106 and manual and/or mechanized pulling of the pipes 106.

It is understood that although riser mount and coupler snap engagement portion 132 is illustrated herein as comprising a protrusion for snap fitting into a recess formed by stabilizer base snap engagement portion 122, the configuration of the snap engagement portions 122 and 132 of stabilizer base 102 and riser mount and coupler 104 respectively may be interchanged, such that snap fit engagement portion 122 of stabilizer base 102 may be embodied as a protrusion receivable by snap fit engagement portion 132 of riser mount and coupler 104. It is further understood that snap fit engagement portions 122 and 132 are not limited to the configurations illustrated herein and may alternatively be embodied as any other suitable type of mating removable snap fit engagement features.

As appreciated from consideration of FIGS. 2A and 2B in conjunction with FIGS. 1A-1C, riser mount and coupler 104 is preferably, but not necessarily, symmetrical, allowing riser mount and coupler 104 to be slid into or out of engagement with stabilizer base 102 from either end of riser mount and coupler 104.

At least one outwardly extending rib may be formed along at least one side of riser mount and coupler 104. Here, by way of example, a first lateral rib 162 and a second lateral rib 164 are shown to be arranged in two tiers along either side of riser mount and coupler 104, first rib 162 forming an upper tier and second rib 164 forming a lower tier, second rib 164 being proximal to slidable portion 130. At least one set of pin-receiving holes 170 and 172 may be formed in first and second ribs 162 and 164, respectively, for receiving pin 142 in a manner detailed henceforth.

It is an advantageous feature of a preferred embodiment of the present invention that at least one pin-receiving hole, such as hole 170 formed in first rib 162, is preferably partially, but not fully, circumferentially surrounded by a projecting shoulder 174. By way of example, shoulder 174 may circumferentially surround a third of the circumference or a quarter of the circumference of each corresponding hole 170 and may have a height in the range of approximately 1-2 mm. Shoulder 174 preferably forms a spacer, spacing apart a head portion of pin 142 from a surface of first rib 162, when pin 142 is inserted into hole 170, thus facilitating subsequent removal of pin 142 from riser mount and coupler 104, in a manner detailed hereinbelow with respect to FIGS. 7A-9C.

Figure 3A:
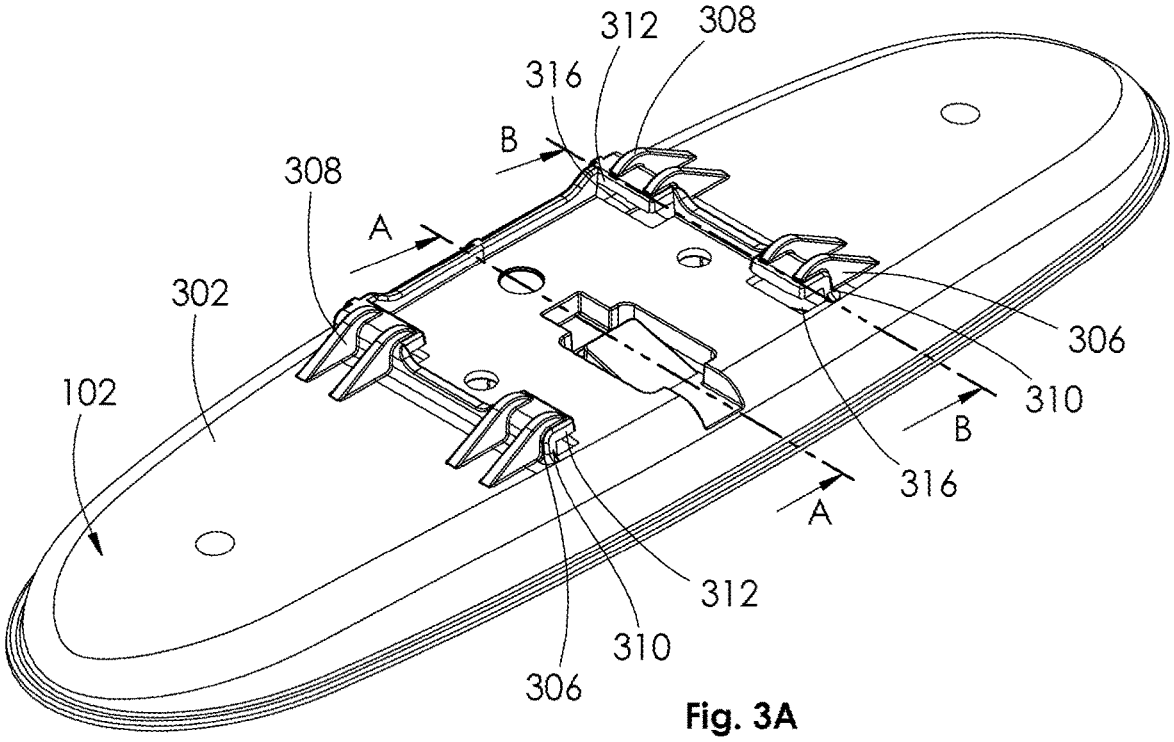
FIGS. 3A and 3B are simplified schematic respective top-side perspective and under-side perspective view illustrations of a stabilizer base of a type shown in FIGS. 1A-1C.
Figure 3B:
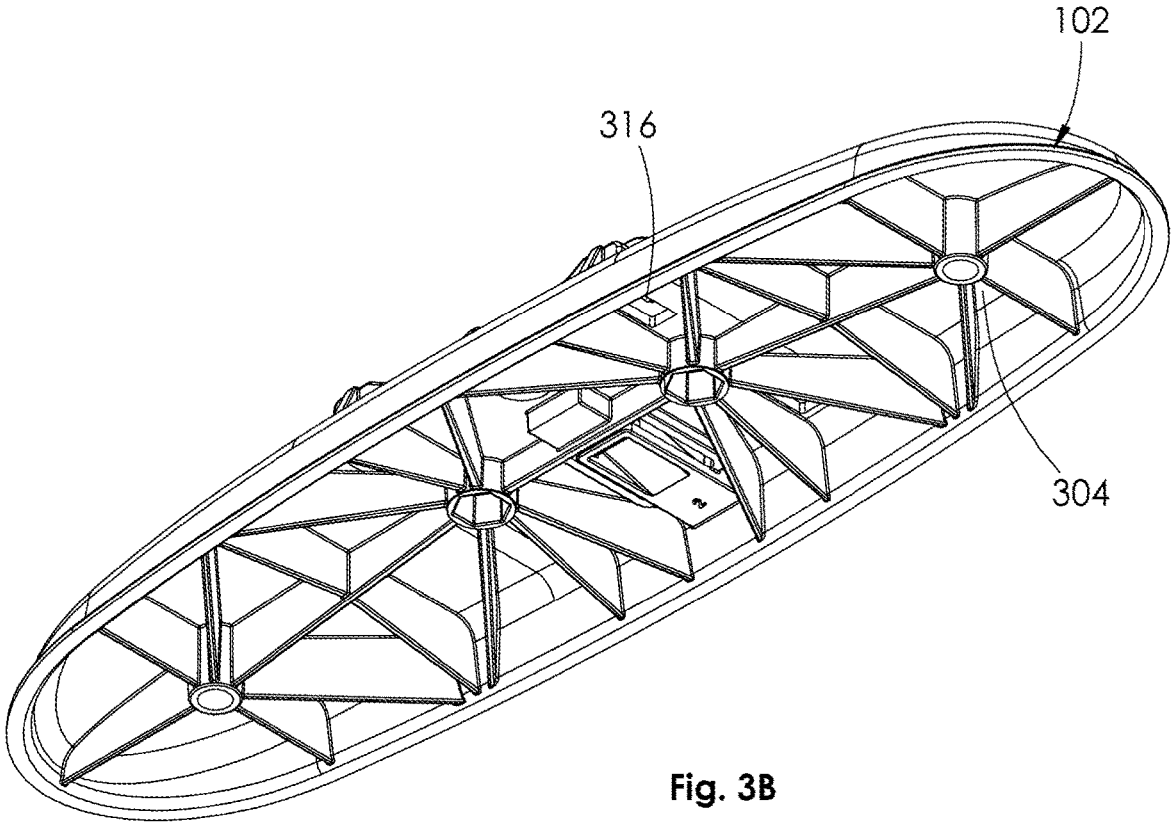
Figure 4A:
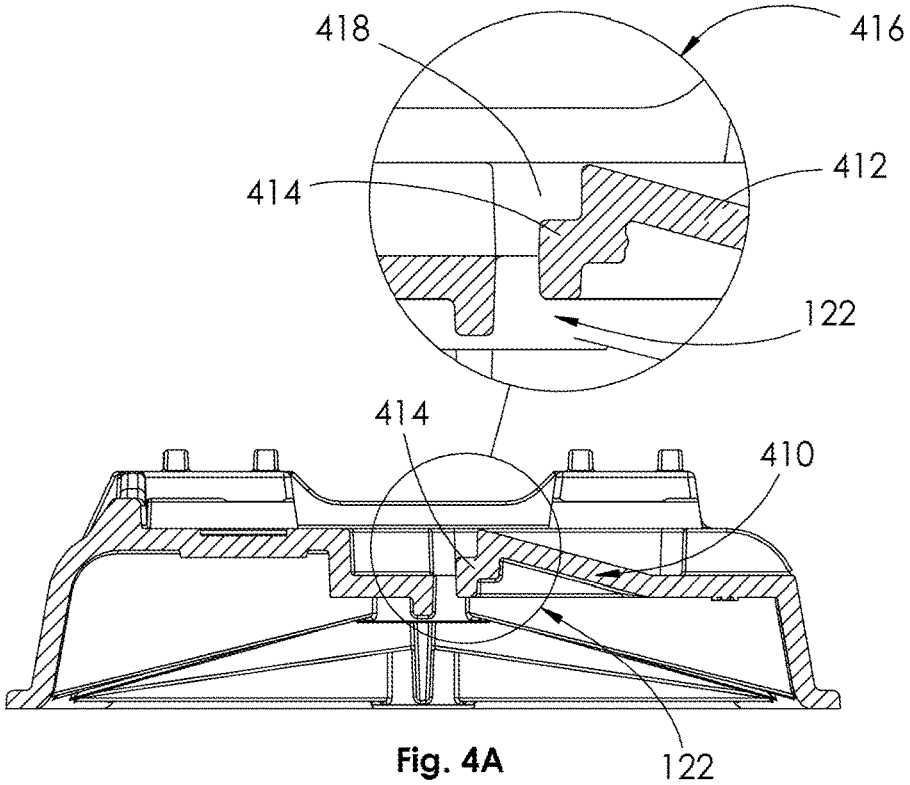
FIGS. 4A, 4B and 4C are simplified cross-sectional illustrations of respective portions of the stabilizer base of FIGS. 3A and 3B, FIGS. 4A and 4B being taken along respective section lines A-A and B-B in FIG. 3A and FIG. 4C being taken along section line C-C in FIG. 4B.
Figure 4B:
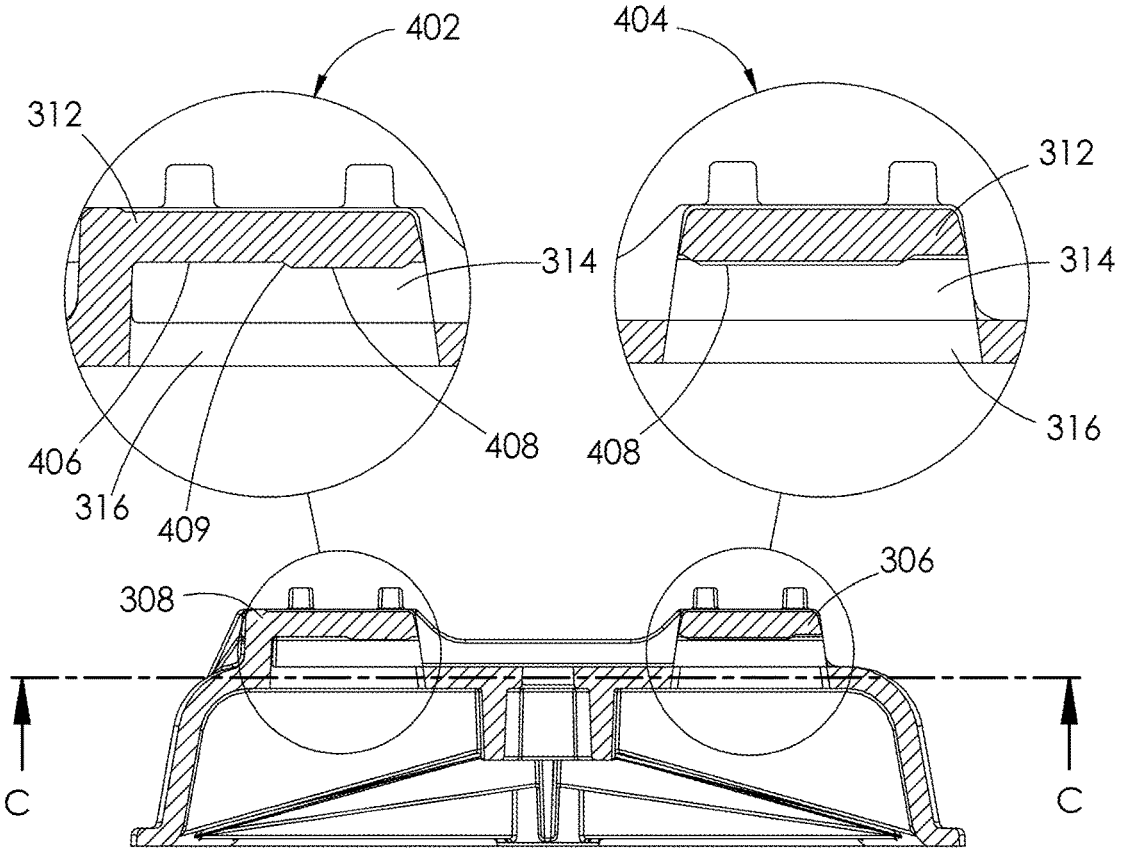
Figure 4C:
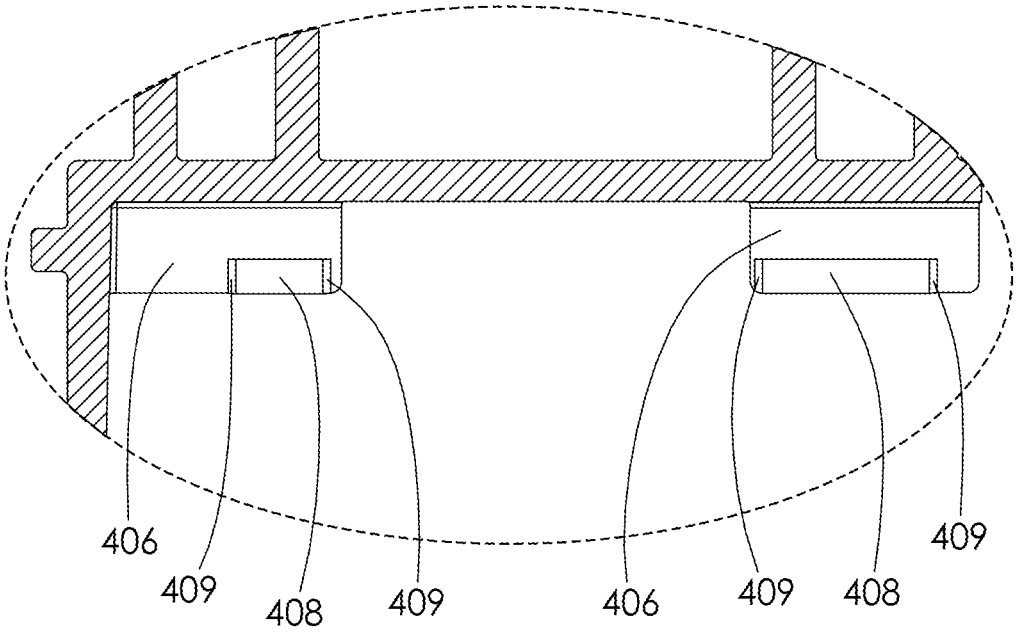

Reference is now made to FIGS. 3A and 3B, which are simplified schematic respective top-side perspective and under-side perspective view illustrations of stabilizer base 102 of a type shown in FIGS. 1A-1C, and to FIGS. 4A, 4B and 4C, which are simplified cross-sectional illustrations of respective portions of the stabilizer base of FIGS. 3A and 3B.

As seen in FIGS. 3A-4C, stabilizer base 102 preferably comprises a generally elongate oval-shaped element, having an upper surface 302, upon which riser mount and coupler 104 is preferably mountable, and a lower surface 304. The at least one pressure mount portion 120, here embodied, by way of example, as two anterior pressure mount portions 306 and two posterior pressure mount portions 308, is preferably formed on upper surface 302.

As seen most clearly in FIGS. 3A and 4B, each pressure mount portion 306 and 308 of pressure mount portions 120 is preferably embodied as an inverted-L shaped ridge, comprising an erect back portion 310 and a head portion 312 bent, with respect thereto, so as to extend generally parallel to upper surface 302 and define a gap 314 therebetween. At least one void 316 is typically formed in stabilizer base 102, extending between upper surface 302 and lower surface 304, located directly beneath each head portion 312 and of dimensions generally corresponding thereto. Alternatively, void 316 may be obviated.

As best seen at enlargements 402 and 404 in FIG. 4B, head portion 312 preferably comprises a non-flat lower surface 406, including a protruding segment 408. Protruding segments 408 preferably exert pressure on slidable portion 130 of riser mount and coupler 104 when slidable portion 130 is engaged with pressure mount portions 120, as is further detailed hereinbelow with reference to FIGS. 5A-5H. As seem particularly clearly in in FIG. 4C, protruding segments 408 are preferably formed with inclined portions 409 adjacent thereto for ease of slidable engagement and disengagement therewith by slidable portion 130.

As seen in FIG. 4A, stabilizer base snap engagement portion 122 preferably comprises a moveable snap engagement element 410 having a resilient slanted segment 412 terminating in a step-like segment 414, as seen most clearly at enlargement 416. Step-like segment 414 preferably defines a recess 418, configured to receive snap fit engagement portion 132 of riser mount and coupler 104 for operative removable snap fit engagement therewith, as is further detailed hereinbelow with reference to FIGS. 5A-5H. It is a particular feature of an embodiment of the present invention that the structure illustrated particularly in FIG. 4A is operative to strengthen the snap-fit engagement of engagement portion 132 of riser mount and coupler 104 responsive to an increase in the applied forces which would otherwise cause disengagement of the riser mount and coupler 104 from the stabilizer base 102.

Reference is now made to FIGS. 5A, 5B, 5C, 5D, 5E, 5F, 5G and 5H, which are simplified drawings showing successive stages in the assembly of a sprinkler riser assembly of a type shown in FIGS. 1A-1C.

Figure 5A:
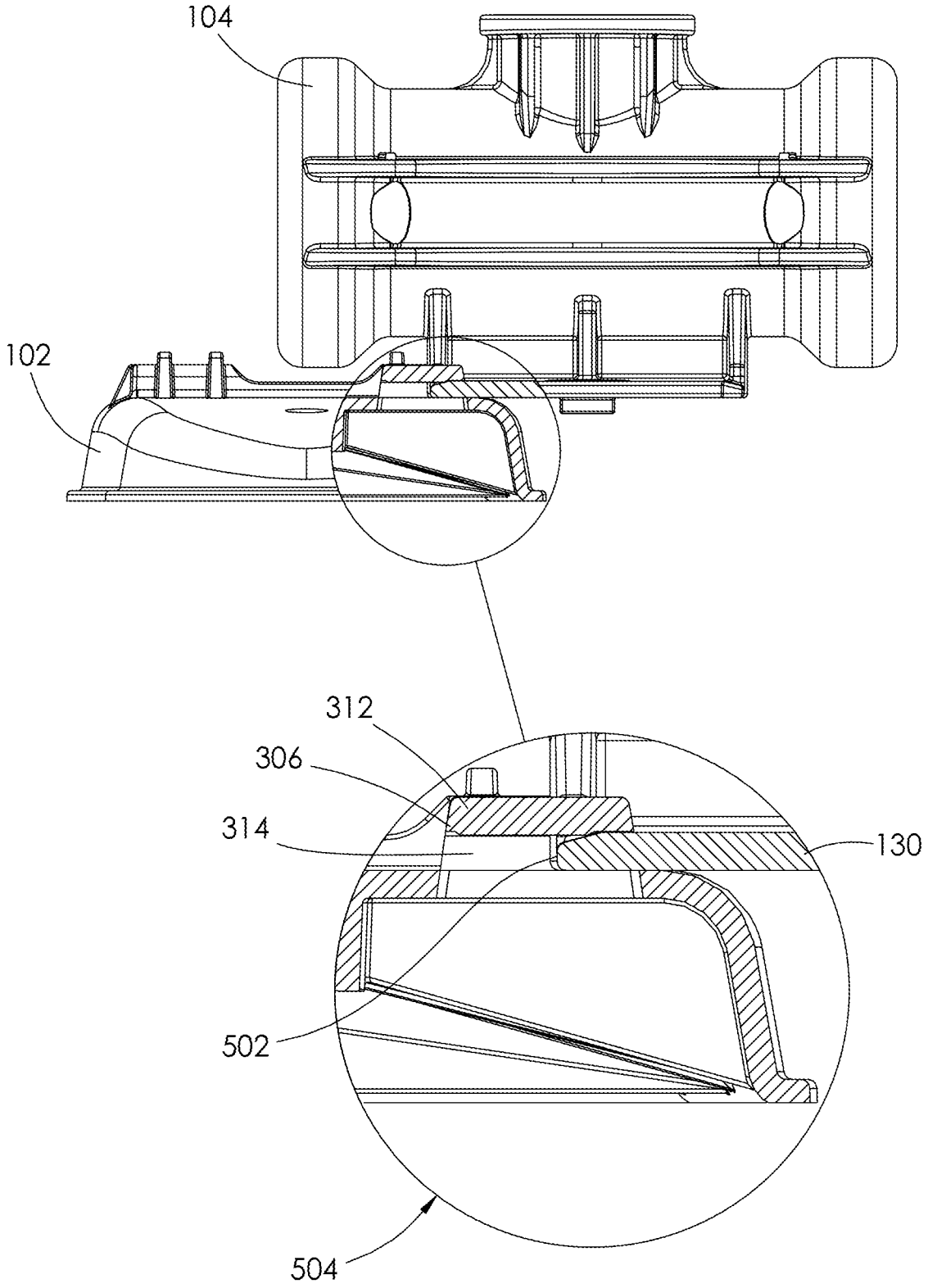
FIGS. 5A, 5B, 5C, 5D, 5E, 5F, 5G and 5H are simplified drawings showing successive stages in the assembly of a sprinkler riser assembly of a type shown in FIGS. 1A-1C.

Turning now to FIG. 5A, showing an initial step in the mounting of riser mount and coupler 104 onto stabilizer base 102, slidable portion 130 of riser mount and coupler 104 is preferably introduced into engagement with at least one pressure mount portion 120. Particularly preferably, a leading edge 502 of slidable portion 130 is slidably entered into gap 314 so as to engage anterior pressure mount portion 306, as seen most clearly at cross-sectional enlargement 504. It is appreciated that although the entry of slidable portion 130 into only one anterior pressure mount portion 306 is shown in FIG. 5A, slidable portion 130 is preferably entered into both of anterior pressure mount portions 306 simultaneously.

Figure 5B:
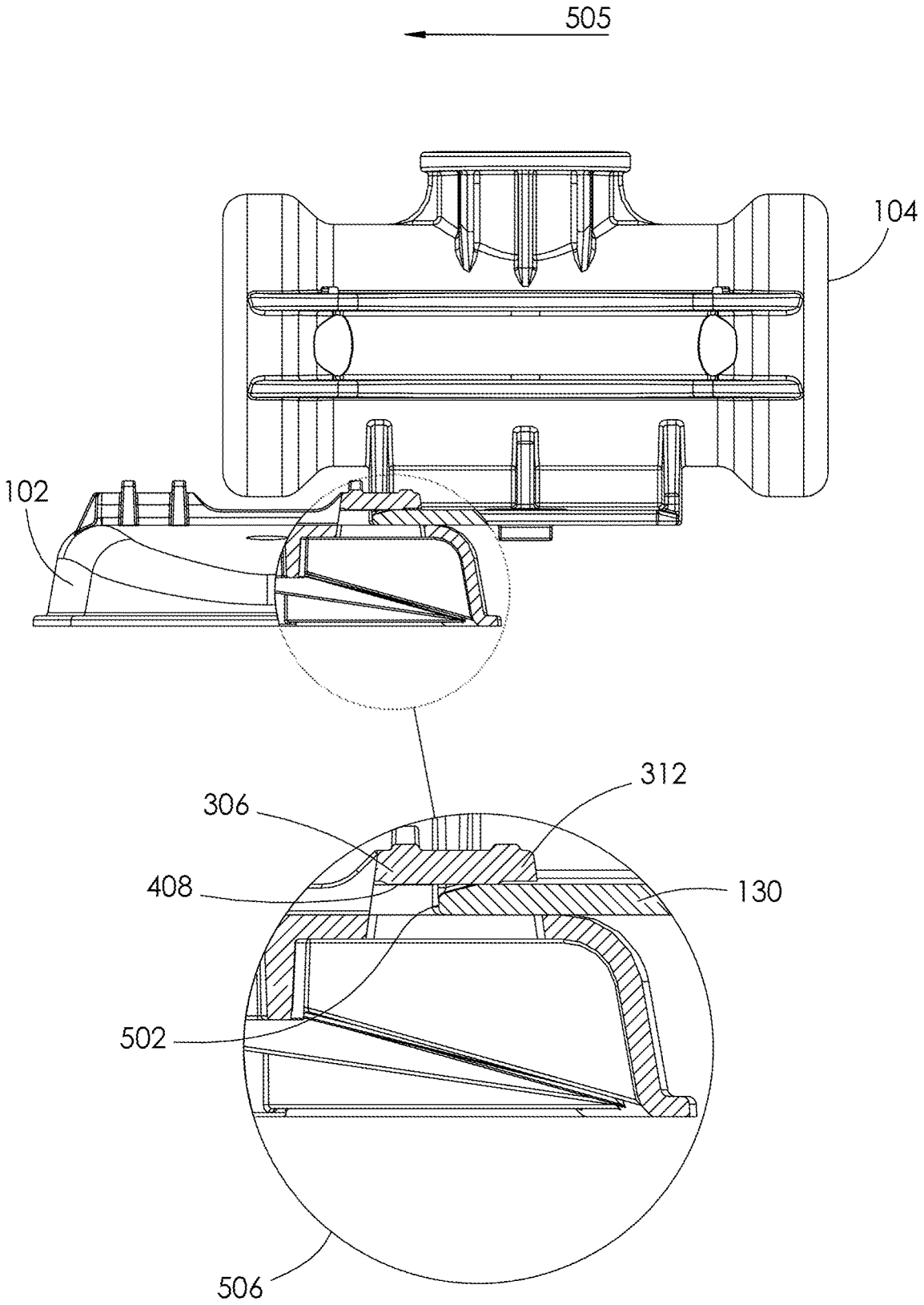

Turning now to FIG. 5B, slidable portion 130 is seen to be progressed inwards along anterior pressure mount portion 306 in a direction generally represented by an arrow 505. Protruding segments 408 preferably exert pressure on slidable portion 130 as slidable portion is slidably progressed therealong, as seen most clearly at cross-sectional enlargement 506.

Figure 5C:
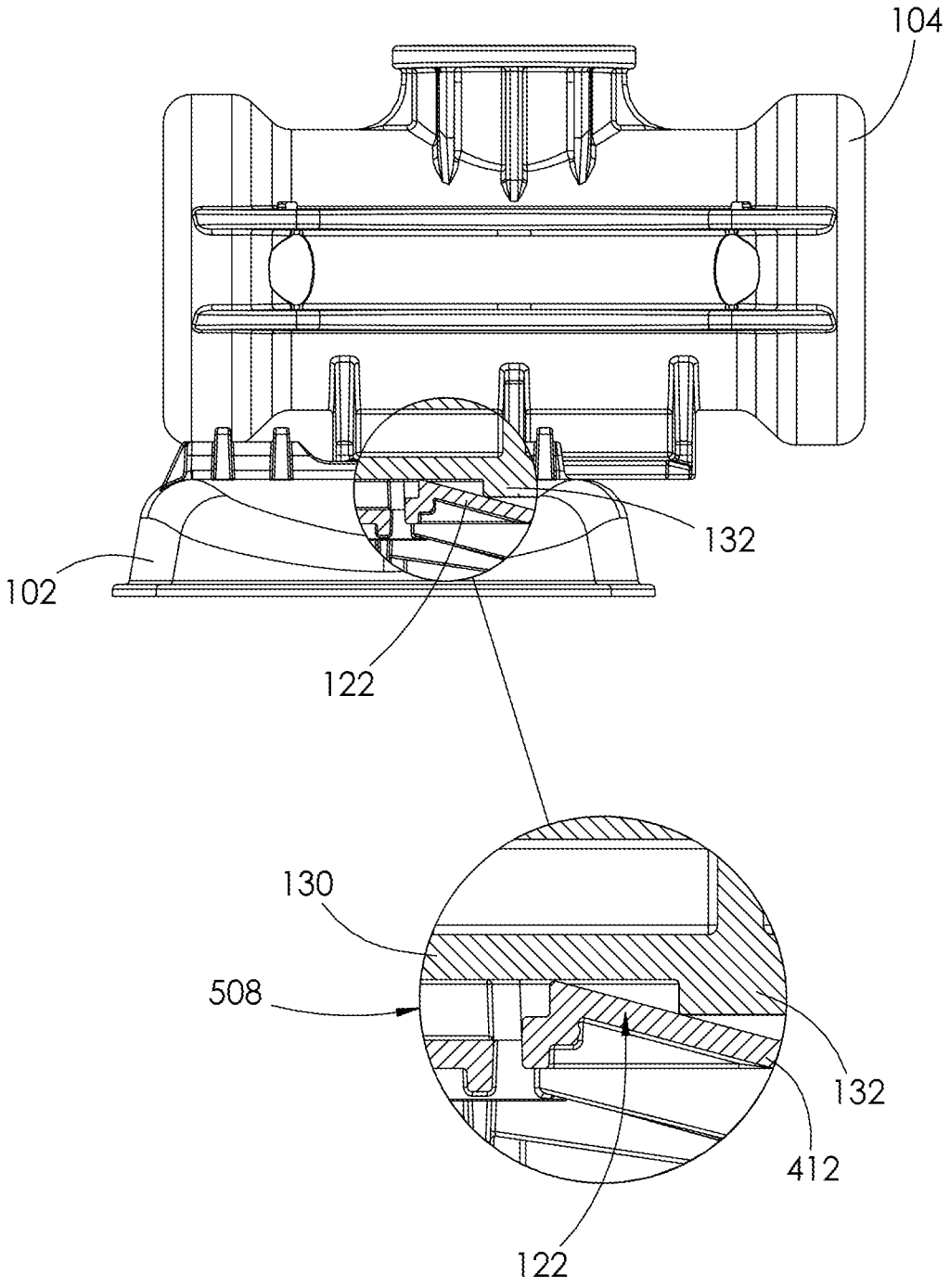

Turning now to FIG. 5C, following the slidable engagement of slidable portion 130 with anterior pressure mount portion 306, slidable portion 130 is seen to be further slidably progressed such that snap fit engagement portion 132 of riser mount and coupler 104 engages snap fit engagement portion 122 of stabilizer base 102. Particularly preferably, the protrusion defined by snap fit engagement portion 132 is urged against slanted segment 412 of snap fit engagement portion 122 of stabilizer base 102, as seen most clearly at cross-sectional enlargement 508.

Figure 5D:
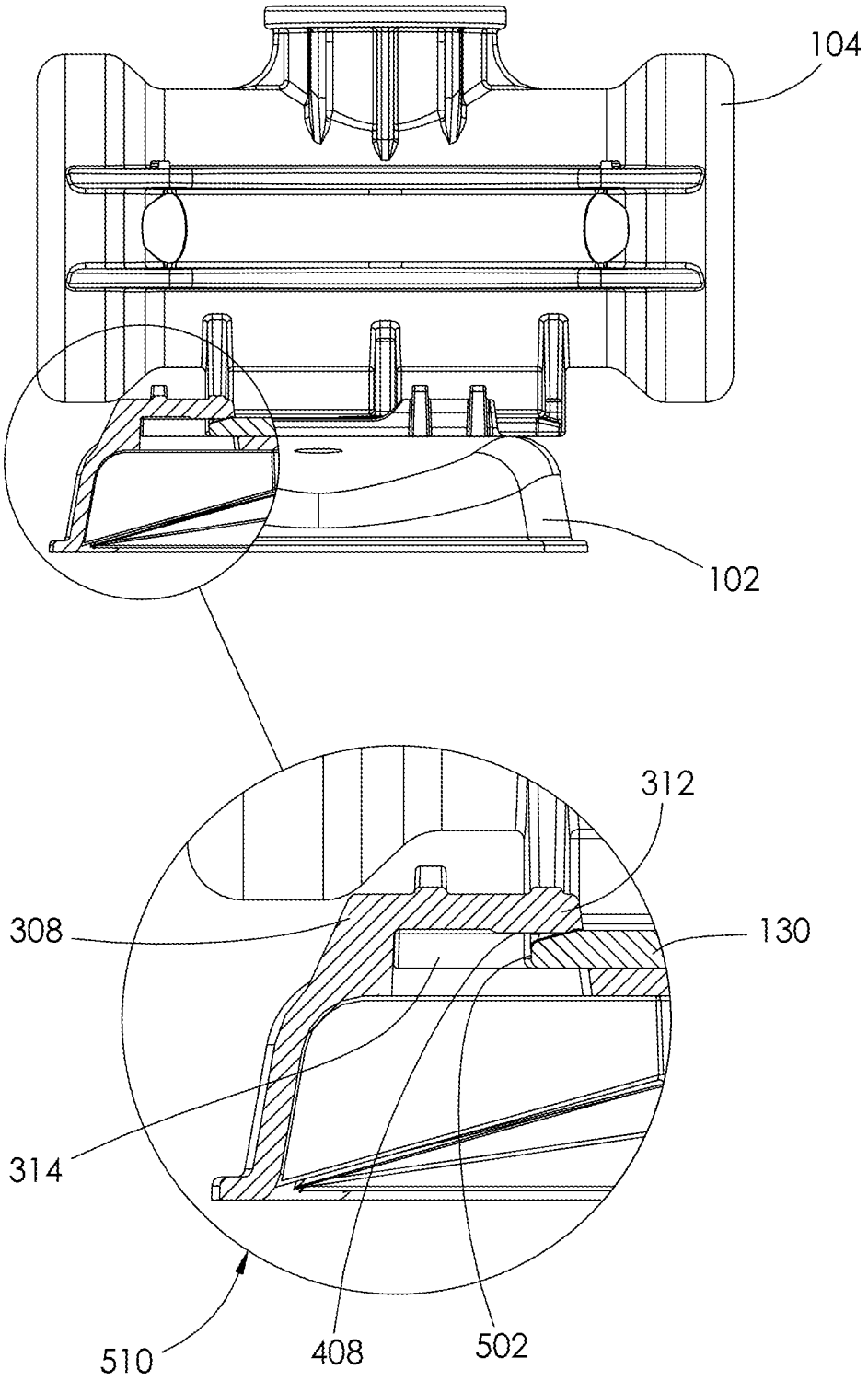

Turning now to FIG. 5D, preferably at least partially simultaneously with the urging of protrusion 132 against slanted segment 412 as shown in FIG. 5C, slidable portion 130 is slidably further progressed towards posterior pressure mount portion 308. Particularly preferably, leading edge 502 of slidable portion 130 is slidably entered into gap 314 of posterior pressure mount portion 308 so as to engage with posterior pressure mount portion 308, as seen most clearly at cross-sectional enlargement 510. It is appreciated that although the entry of slidable portion 130 into only one posterior pressure mount portion 308 is shown in FIG. 5D, slidable portion 130 is preferably entered into both of anterior pressure mount portions 308 simultaneously.

Figure 5E:
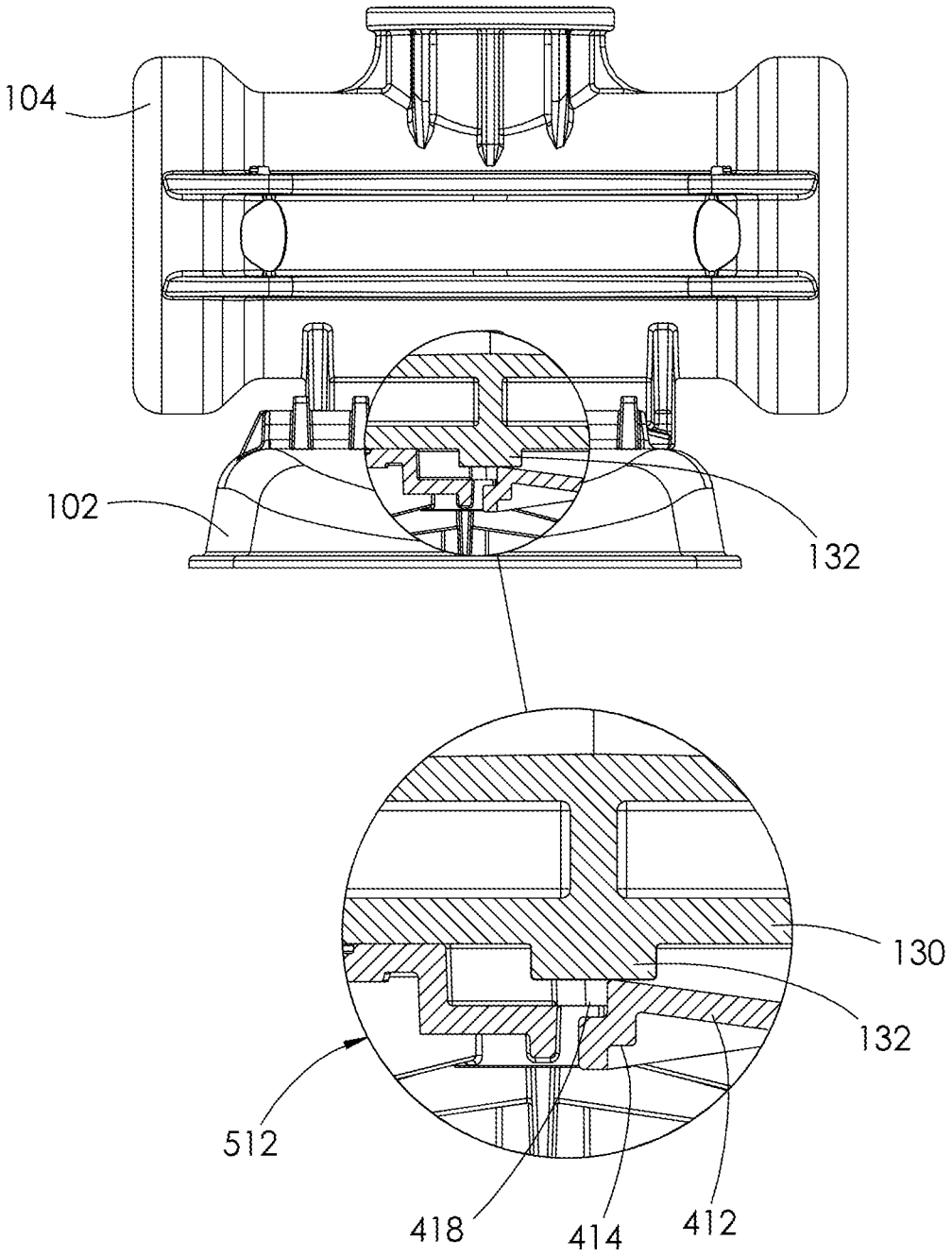
Figure 5F:
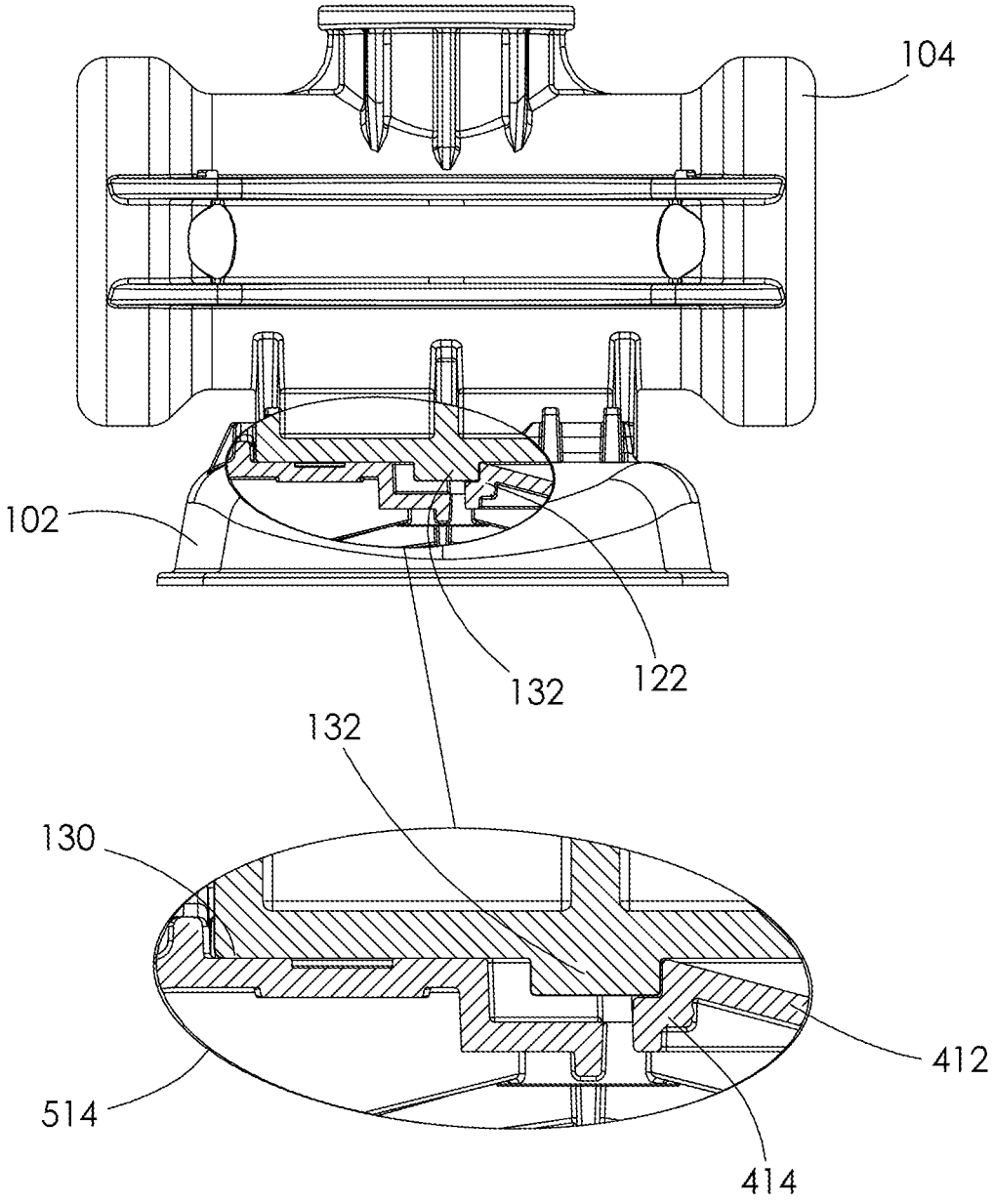

Turning now to FIG. 5E, slidable portion 130 is further slidably progressed such that protrusion 132 is further urged against slanted segment 412, thereby depressing slanted segment 412, as seen most clearly at cross-sectional enlargement 512. Upon protrusion 132 being slidably progressed beyond slanted section 412, protrusion 132 is received in indented receiving recess 418, thereby becoming locked between step-like segment 414 and slanted segment 412 in snap-fitting engagement, as seen most clearly at cross-sectional enlargement 514 in FIG. 5F.

Figure 5G:
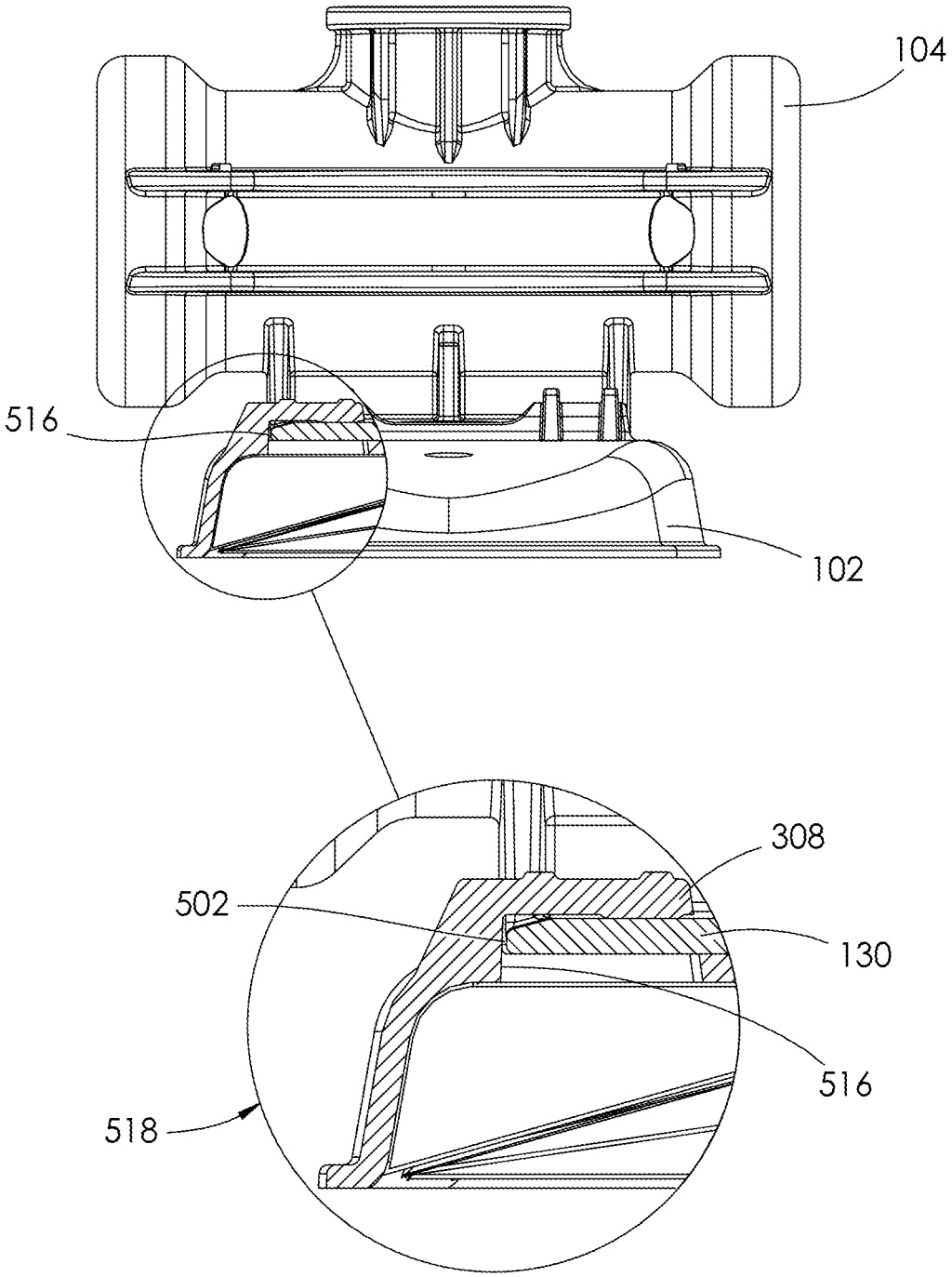

Turning now to FIG. 5G, illustrating a final step in the mounting of riser mount and coupler 104 onto stabilizer base 102, slidable portion 130 is slidably further progressed along posterior pressure mount portion 308 so as to be fully engaged therewith. Further sliding of slidable portion 130 is preferably prevented by the presence of a back wall 516, against which back wall 516 leading edge 502 of slidable portion 130 preferably abuts when riser mount and coupler 104 is fully mounted on stabilizer base 102, as seen most clearly at enlargement 518.

It is understood that the above-described stages in the mounting of riser mount and coupler 104 on stabilizer base 102 may be manually performed by a user of riser assembly 100, without requiring the use of any tools.

It is additionally understood that although the stages in the mounting of riser mount and coupler 104 on stabilizer base 102 are illustrated and correspondingly described hereinabove as occurring in a sequential, incremental manner, various ones of the stages may occur simultaneously or at least partially simultaneously. Furthermore, various ones of the stages may be reordered with respect to other ones of the stages, depending on the particular design features of the riser assembly of the present invention.

It is a particularly advantageous feature of a preferred embodiment of the present invention that the at least one stabilizer base snap engagement portion 122 and the riser mount and coupler snap engagement portion 132 are configured such that application of a tensile force urging sliding disengagement of the riser mount and coupler snap engagement portion 132 from the at least one stabilizer base snap engagement portion 122 is operative to increase resistance to disengagement of slidable portion 130 of riser mount and coupler 104 from the at least one pressure mount portion 120 of stabilizer base 102.

Figure 5H:
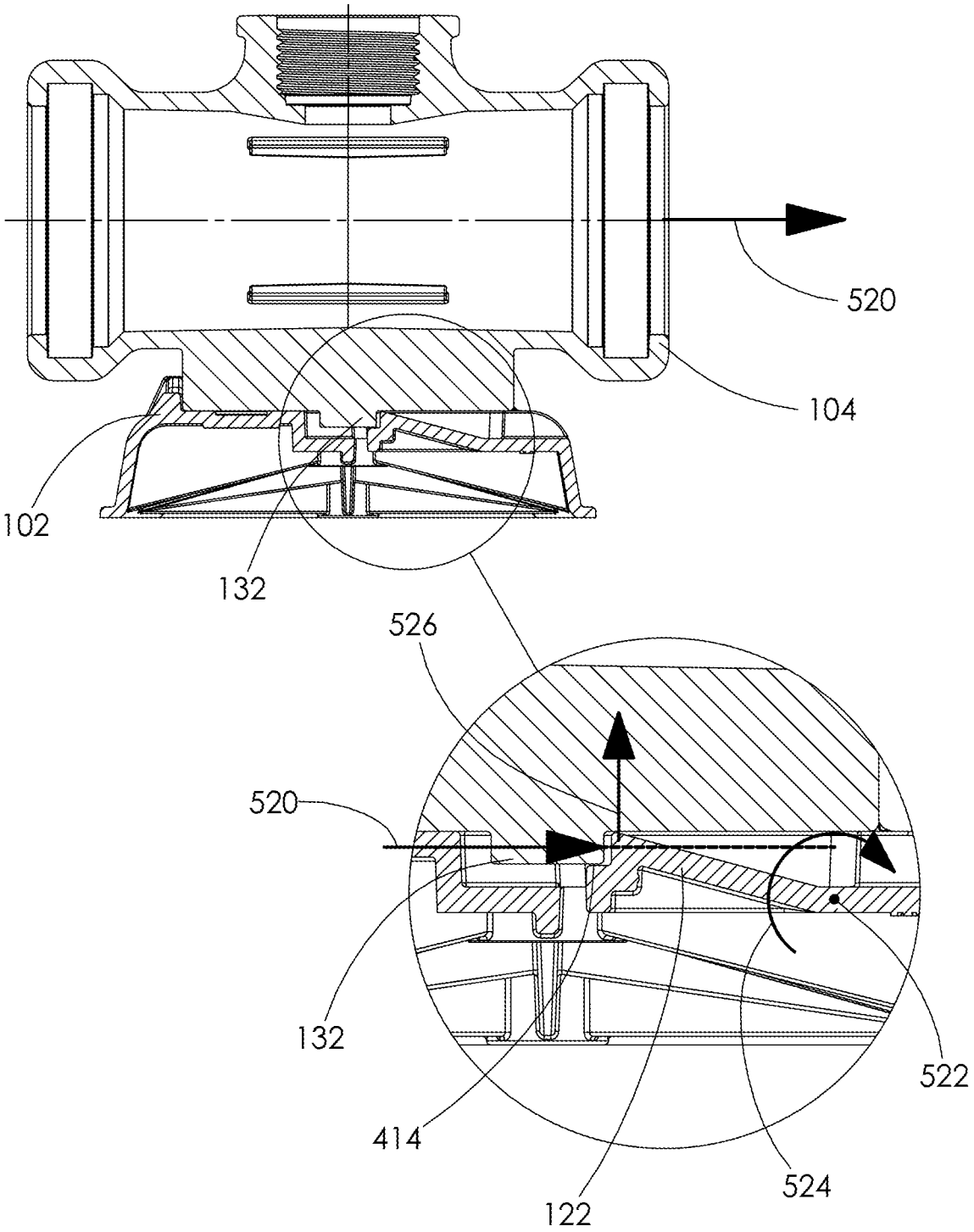

The mechanism by which this may be achieved in the present invention may be best understood with reference to FIG. 5H. Turning to FIG. 5H, a tensile force urging sliding disengagement of the riser mount and coupler snap engagement portion 132 from the stabilizer base engagement portion 122 is generally represented by a first arrow 520. Such a tensile force may be an externally applied force, for example by a user or due to an external impact, or may be an internal force due to thermal expansion or pressure of water in pipes 106. Tensile force 520 preferably creates a torque on stabilizer base 102 about an axis of rotation 522, causing rotation of stabilizer base 102 about axis of rotation 522 in a direction generally indicated by a second arrow 524. The rotation of stabilizer base 102 in a direction generally indicated by second arrow 524 creates a region of high pressure at the interface of step-like segment 414 and riser mount and coupler snap engagement portion 132, thus forcing stabilizer base snap engagement portion 122 in an upwards direction generally indicated by a third arrow 526. The upward displacement of stabilizer base snap engagement portion 122 decreases the likelihood that coupler snap engagement portion 132 could be pulled out of recess 418. In addition, the upward thrust applied to slidable portion 130 leads to slidable portion 130 being urged against at least one pressure mount portion 120, thereby increasing the resistance to disengagement of slidable portion 130 from at least one pressure mount portion 120.

It is appreciated that once riser mount and coupler 104 is mounted on stabilizer base 102, as illustrated in FIG. 5H, riser mount and coupler 104 is thus adapted to resist accidental disengagement from stabilizer base 102 due to the unique structure of the snap engagement and pressure mount portions thereof, thereby rendering sprinkler riser assembly 100 particularly robust and resistant to disengagement from pipes 106.

Figure 6:
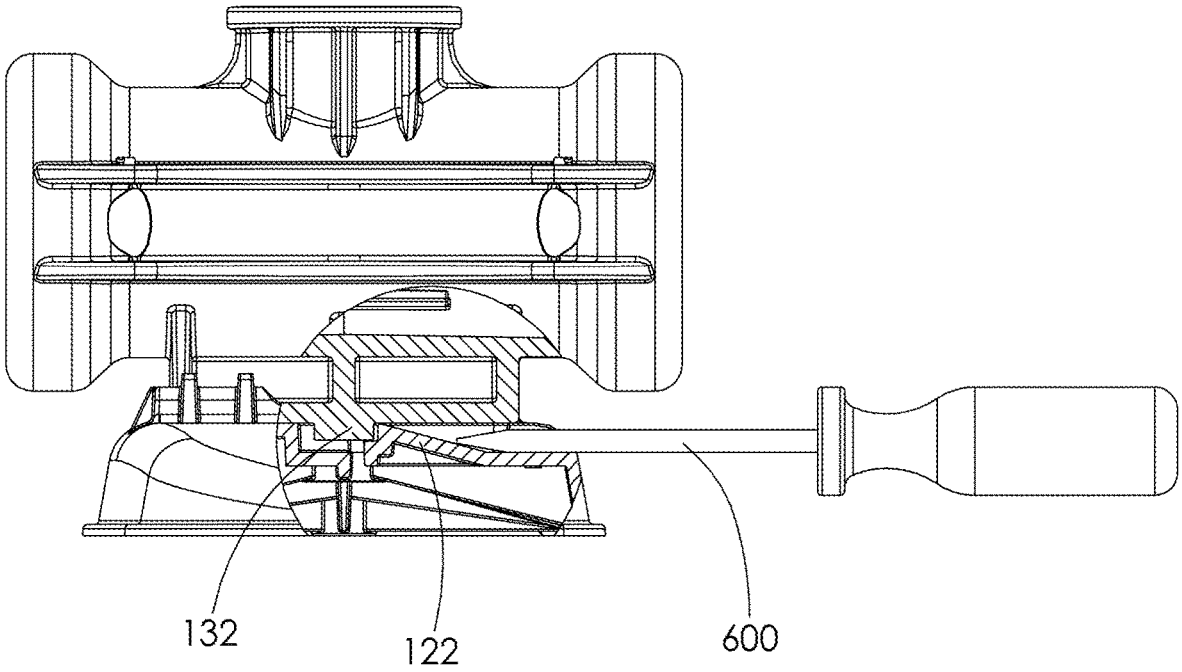
FIG. 6 is a simplified drawing illustrating disengagement of a riser mount and coupler from a stabilizer base of a sprinkler riser assembly of a type shown in FIGS. 1A-1C.

When a user of sprinkler riser assembly 100 wishes to disengage riser mount and coupler 104 from stabilizer base 102, for example for maintenance purposes, snap fit engagement portions 122 and 132 may be mutually disengaged by displacement of at least one of snap fit engagement portions 122 and 132. By way of example, snap fit engagement portion 122 may be released by application of a force thereto by a tool, such as a screwdriver 600, as illustrated in FIG. 6.

Reference is now made to FIGS. 7A-7D, which are simplified schematic respective first and second perspective, side and top view illustrations of manually operable removably engagement hook 140 of a sprinkler riser assembly of a type shown in FIGS. 1A-1C, constructed and operative in accordance with a preferred embodiment of the present invention.

As seen in FIGS. 7A-7D, manually operable removably engageable hook 140 preferably comprises a broad, ergonomic upper hand-holdable portion 702, enabling easy engagement of manually operable removably engageable hook 140 by a user, and a pin-receiving hole 704 for receiving pin 142 so as to enable attachment of manually operable removably engageable hook 140 to riser mount and coupler 104. Pin-receiving hole 704 preferably has a bore with an irregular inner surface. By way of example, the bore may have a crenellated inner surface 706 formed by a multiplicity of notches 708 extending therealong. The presence of notches 708 serves to prevent buildup and facilitate release of sediments such as sand that may otherwise accumulate in hole 704. It is appreciated that the particular number and arrangement of notches 708 shown in FIGS. 7A-7D is exemplary only and that pin-receiving hole may include a greater or fewer number of notches arranged in any suitable configuration therewithin.

Figure 8A:
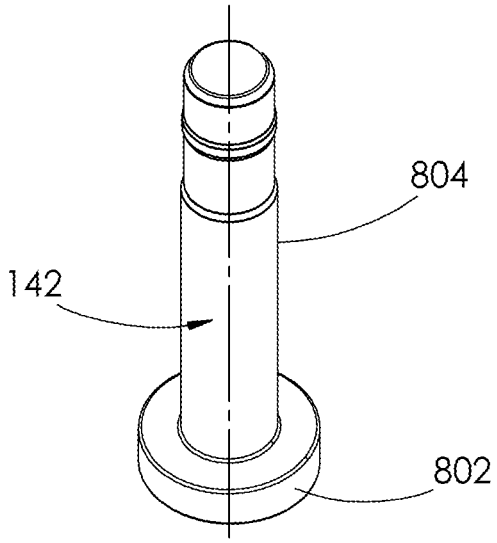
FIGS. 8A and 8B are simplified respective perspective and side-view illustrations of a pin adapted for securing a manually operable removably engageable hook portion of a type shown in FIGS. 7A-7D, constructed and operative in accordance with a preferred embodiment of the present invention.
Figure 8B:
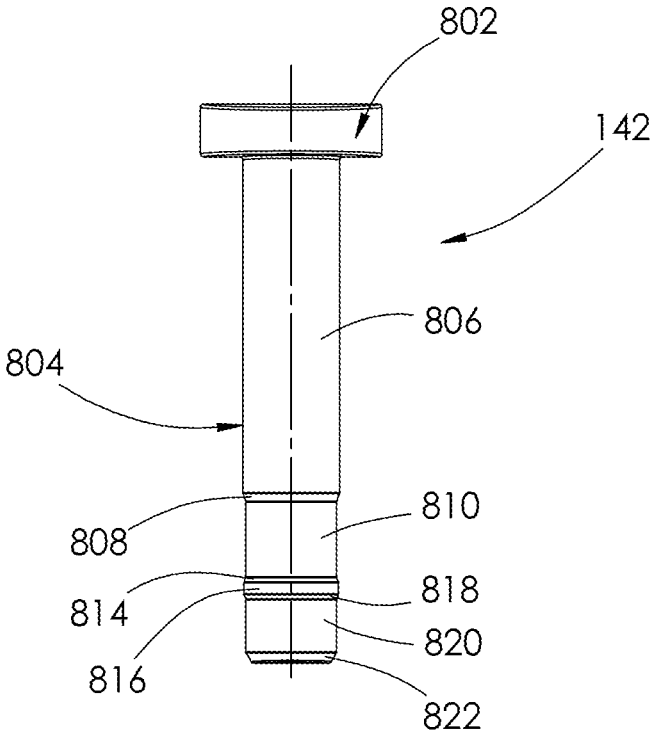

Hole 704 is preferably sized to receive pin 142 therein. As seen in FIGS. 8A and 8B, pin 142 preferably comprises a head portion 802 and a shank portion 804. Shank portion 804 preferably has a gradated circumference. By way of example, shank portion 804 may include an upper segment 806 proximal to head 802 and having a first diameter. Upper segment 806 preferably terminates at a first tapered region 808, which terminates in a first intermediate segment 810, having a second diameter, which is less than the first diameter.

Below first intermediate segment 810 in the sense of FIG. 8B, is a second tapered segment 814 which extends to a second intermediate segment 816, having a third diameter, which is less than the first diameter and greater than the second diameter. Below the second intermediate segment 816, in the sense of FIG. 8B, is a third tapered segment 818, which extends to a bottom segment 820, having a fourth diameter, which is less than the third diameter. Bottom segment 820 terminates in a fourth tapered segment 822.

Figure 9A:
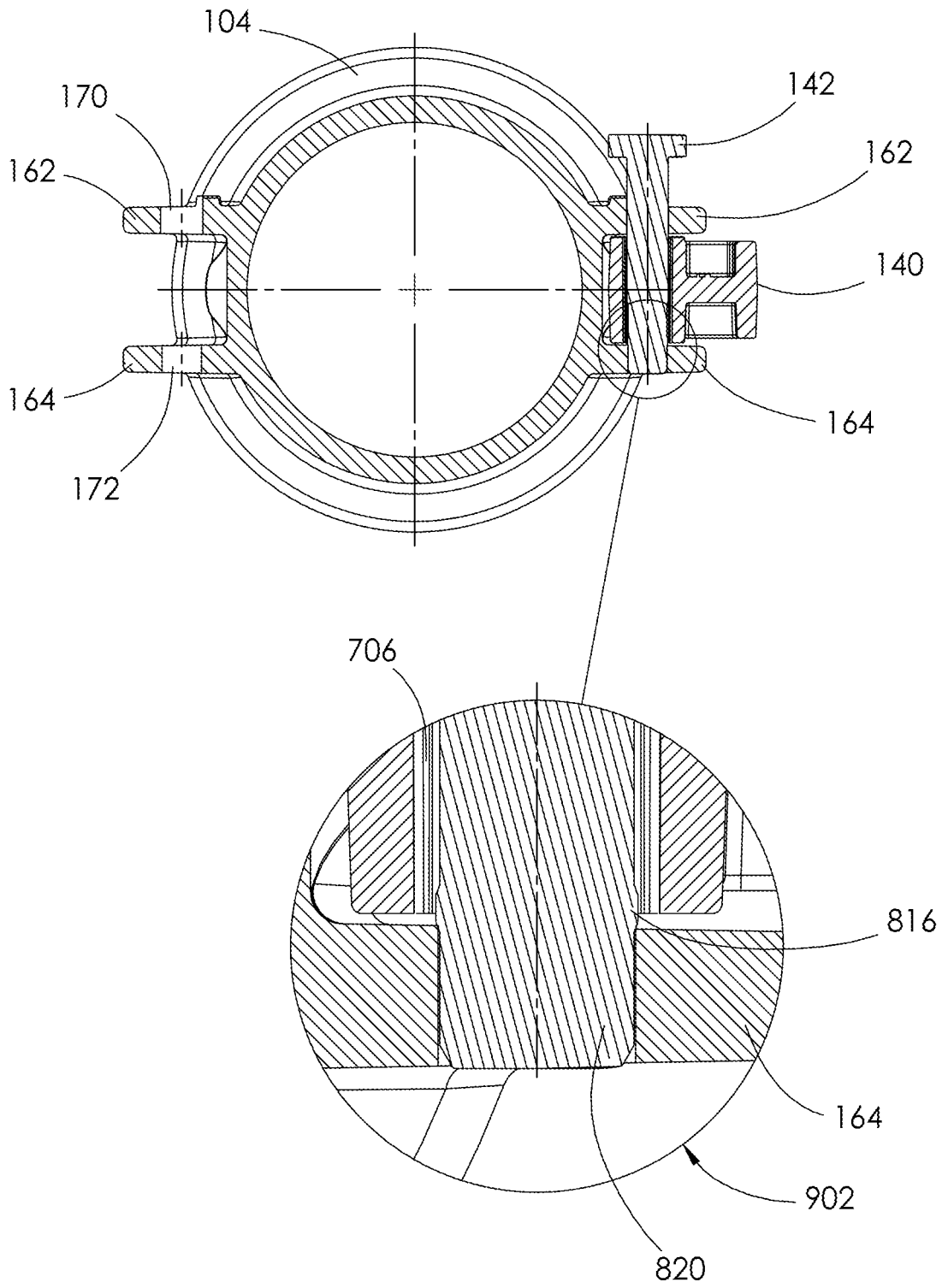
FIGS. 9A and 9B are simplified schematic cross-sectional front view illustrations of a riser mount and coupler of a type shown in FIGS. 1A-2C, including a manually operable removably engageable hook portion and pin of types shown in FIGS. 7A-8B, respectively partially assembled and fully assembled therewith.

In assembling manually operable removably engageable hook 140 with riser mount and coupler 104, manually operable removably engageable hook 140 is preferably inserted between first and second ribs 162, 164 of riser mount and coupler 104, and hole 704 is aligned with holes 170 and 172 therein, as seen in FIG. 9A. It is a particularly advantageous feature of a preferred embodiment of manually operable removably engageable hook 140 that manually operable removably engageable hook 140 does not require compression of a spring in order to be attached to riser mount and coupler 104 by pin 142, but rather may be simply and conveniently juxtaposed thereto for attachment.

Pin 142 may be inserted through holes 170, 704 and 172 successively. Hole 170 in first rib 162 preferably has a diameter permitting unimpeded passage of shank portion 804 therethrough. Hole 172 in second rib 164 preferably has a smaller diameter than hole 170, such that pin 142 preferably settles with second intermediate portion 816 resting on an entrance of hole 172 in second rib 164, as seen most clearly at enlargement 902 in FIG. 9A. It is understood that pin 142 preferably settles in this position upon manual insertion by a user, without requiring the application of force thereto.

Figure 9B:
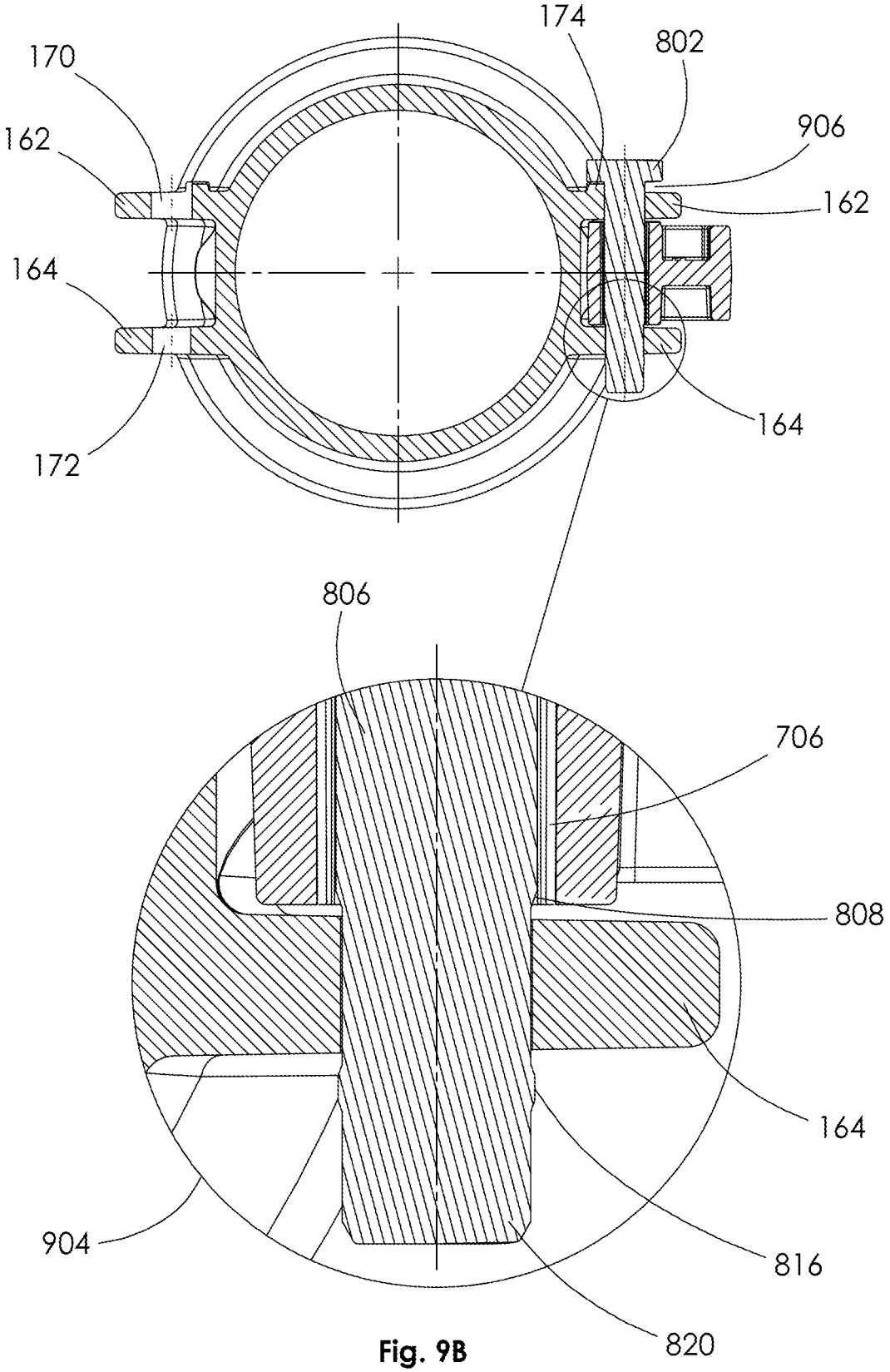

In order to secure manually operable removably engageable hook 140 to riser mount and coupler 104, a user may then press down on head portion 802 of pin 142, forcing second intermediate portion 816 through hole 172, causing pin 142 to be seated with head portion 802 abutting shoulder 174 and first tapered portion 808 above hole 172, as best seen at an enlargement 904 in FIG. 9B.

Figure 9C:
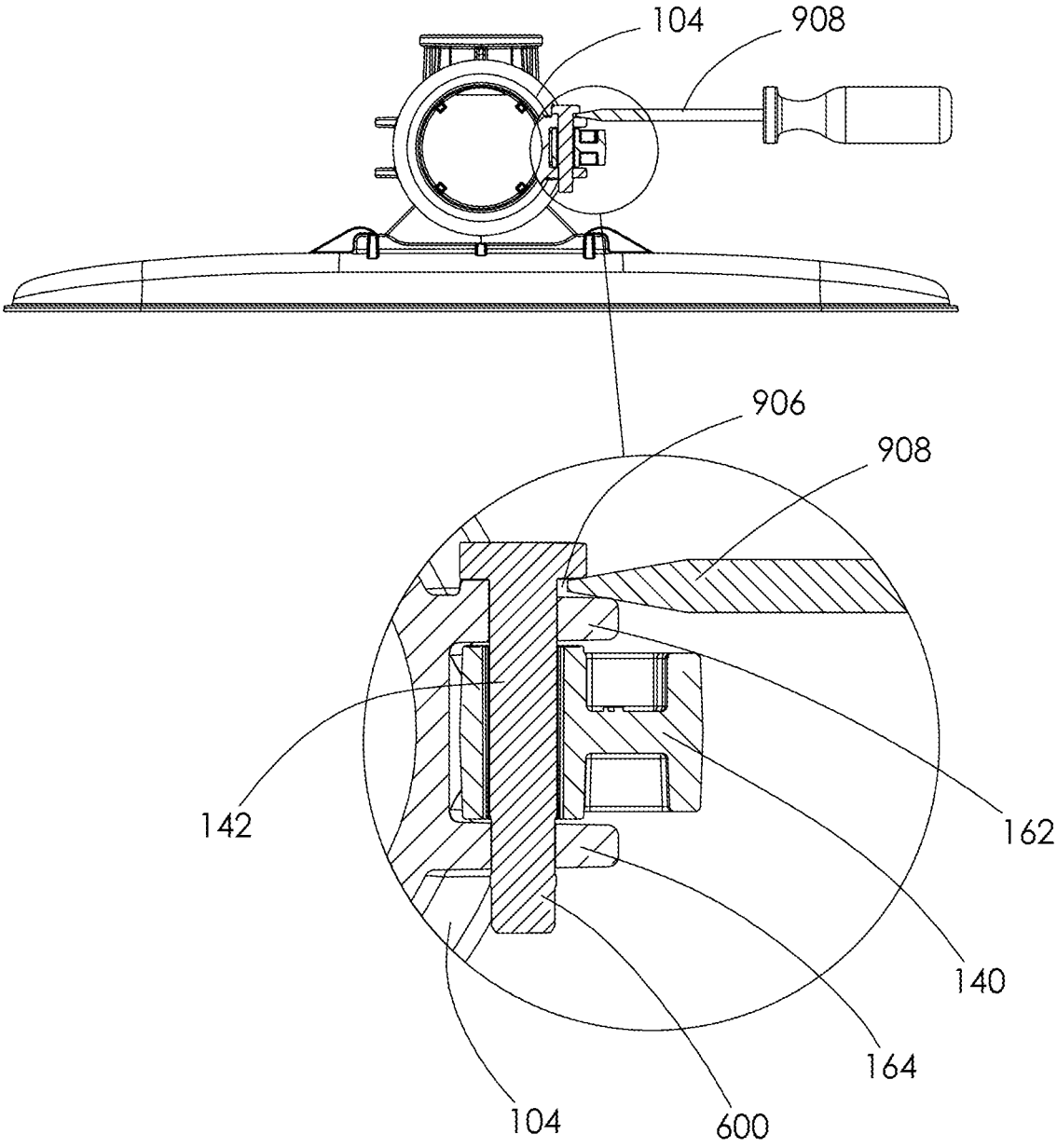
FIG. 9C is a simplified drawing illustrating disengagement of the manually operable removably engageable hook portion and pin from the riser mount and coupler of FIGS. 9A and 9B.

A space 906 is preferably defined between head portion 802 and a surface of first rib 162 due to the intervening presence of shoulder 174 therebetween, as seen in FIG. 9B. As seen in FIG. 9C, in order to remove pin 142 and thus disengage manually operable removably engageable hook 140 from riser mount and coupler 104, a user may insert a tool, such as a screwdriver 908, into space 906 and thereby easily pry pin 142 out of engagement with ribs 162 and 164. It is appreciated that alternatively, space 906 may be defined other than by providing shoulder 174.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. A sprinkler riser assembly comprising:

a stabilizer base defining a generally planar top surface;

a riser mount and coupler, removably mountable onto said stabilizer base above said generally planar top surface;

at least one manually operable removably engageable hook removably attachable to said riser mount and coupler, said at least one manually operable removably engageable hook comprising at least one manually operable removably engageable hook pin-receiving hole; and at least one pin, including a head portion and a shank portion, said stabilizer base including:

at least one pressure mount portion; and at least one stabilizer base snap engagement portion, said riser mount and coupler including:

a generally planar slidable portion for connecting to the at least one pressure mount portion of said stabilizer base by sliding over a portion of said generally planar top surface of said stabilizer base, at least one riser mount and coupler snap engagement portion for operative removable snap fit engagement with said at least one stabilizer base snap engagement portion; and at least one first lateral rib, including a first rib pin-receiving hole formed therein, and at least one second lateral rib, including a second rib pin-receiving hole formed therein, said first and second lateral rib pin-receiving holes being generally mutually aligned, and said shank portion of said at least one pin including:

an upper segment, adjacent said head portion, a first tapered region, adjacent said upper segment;

a first intermediate segment, adjacent said first tapered region;

a second tapered segment, adjacent said first intermediate segment;

a second intermediate segment, adjacent said second tapered segment;

a third tapered segment, adjacent said second intermediate segment;

a bottom segment, adjacent said third tapered segment; and a fourth tapered segment, adjacent said bottom segment, said manually operable removably engageable hook being attachable to said at least first and second lateral ribs by insertion of said at least one pin through said manually operable removably engageable hook and said first and second rib pin-receiving holes, said first rib pin-receiving hole having a diameter permitting unimpeded passage of said shank portion therethrough; and said second rib pin-receiving hole having a diameter less than the diameter of said first rib pin-receiving hole, thereby causing said second intermediate segment of said shank portion, upon insertion of said at least one pin through said first rib pin-receiving hole, to rest on an entrance of said second rib pin-receiving hole.

2. A sprinkler riser assembly according to claim 1 and wherein said at least one stabilizer base snap engagement portion and said riser mount and coupler snap engagement portion are configured such that application of a tensile force urging sliding disengagement of said riser mount and coupler snap engagement portion from said at least one stabilizer base snap engagement portion is operative to increase resistance to disengagement of said generally planar slidable portion of said riser mount and coupler from said stabilizer base.

3. A sprinkler riser assembly according to claim 2, wherein said at least one riser mount and coupler snap engagement portion comprises a protrusion extending from said generally planar slidable portion and said at least one stabilizer base snap engagement portion comprises a moveable element for operative removable snap fit engagement with said protrusion, said application of said tensile force creating a torque on said moveable element causing rotation of said moveable element about an axis of rotation thereof, said rotation urging said protrusion in a direction towards said at least one pressure mount portion, thereby increasing resistance to disengagement of said generally planar slidable portion from said at least one pressure mount portion.

4. A sprinkler riser assembly according to claim 3, wherein said moveable element comprises a resilient slanted portion terminating in a step-like segment, said step-like segment defining a recess for receiving said protrusion for snap fit engagement therewith.

5. A sprinkler riser assembly according to claim 1, wherein said stabilizer base comprises a surface and said at least one pressure mount portion comprises at least one ridge formed on said surface, a gap being defined between said at least one ridge and said surface, said generally planar slidable portion being sized so as to be slidable within said gap.

6. A sprinkler riser assembly according to claim 5, wherein said at least one pressure mount portion comprises an even number of pressure mount portions symmetrically arranged with respect to said at least one stabilizer base snap engagement portion.

7. A sprinkler riser assembly according to claim 1, wherein said manually operable removably engageable hook pin-receiving hole comprises a bore, said bore having an irregular inner surface.

8. A sprinkler riser assembly according to claim 7, wherein said irregular inner surface comprises a multiplicity of notches.

9. A sprinkler riser assembly according to claim 1, wherein said at least one rib pin-receiving hole is partially but not fully circumferentially surrounded by a shoulder.

10. A sprinkler riser assembly according to claim 9, wherein said shoulder circumferentially surrounds at least a quarter of a circumference of said at least one rib pin-receiving hole.

11. A sprinkler riser assembly according to claim 1, and wherein a gap is defined between said head portion and said at least one first lateral rib upon said insertion of said at least one pin through said manually operable removably engageable hook and said first and second rib pin-receiving holes.

* * * * *